US008322506B2

(12) United States Patent
Abe et al.

(10) Patent No.: US 8,322,506 B2
(45) Date of Patent: Dec. 4, 2012

(54) REEDING DETECTION APPARATUS AND COIN SORTING APPARATUS HAVING THE SAME

(75) Inventors: Hiroshi Abe, Saitama (JP); Takahito Yamamiya, Saitama (JP)

(73) Assignee: Asahi Seiko Co., Ltd., Tokyo (JP)

( * ) Notice: Subject to any disclaimer, the term of this patent is extended or adjusted under 35 U.S.C. 154(b) by 20 days.

(21) Appl. No.: 13/021,935

(22) Filed: Feb. 7, 2011

(65) Prior Publication Data

US 2011/0195649 A1 Aug. 11, 2011

(30) Foreign Application Priority Data

Feb. 8, 2010 (JP) ..... 2010-025951

(51) Int. Cl.
*G07D 5/00* (2006.01)

(52) U.S. Cl. ..... 194/331

(58) Field of Classification Search ..... 194/321–325, 194/344–346

See application file for complete search history.

(56) References Cited

U.S. PATENT DOCUMENTS 7,946,407 B2 5/2011 Abe et al.

FOREIGN PATENT DOCUMENTS

| | | |
|---|---|---|
| JP | H8-022564 | 1/1996 |
| JP | H8-235407 | 9/1996 |
| JP | H9-167270 | 6/1997 |

*Primary Examiner* — Jeffrey Shapiro

(74) *Attorney, Agent, or Firm* — Greenblum & Bernstein, P.L.C.

(57) ABSTRACT

An end of a detection body provided contactable with an upper side peripheral surface of a coin rolling on a coin path hooks into reeding of the coin, and thus the detection body is moved to a moving direction. The movement of the detection body moves a receiving portion in the same direction, and rotates in a predetermined direction an axis support integrally provided with the receiving portion. The rotation of the axis receiver retracts from the coin path a sorting body projecting to the coin path. A release body proceeds to the coin path. The retraction of the sorting body from the coin path allows the coin to further roll on the coin path, press the release body, rotate the axis support reversely, and return the detection body and the sorting body to a standby position.

5 Claims, 28 Drawing Sheets

REEDING DETECTION APPARATUS AND COIN SORTING APPARATUS HAVING THE SAME

CROSS-REFERENCE TO RELATED APPLICATIONS

The present application claims priority under 35 U.S.C. §119 of Japanese Application No. 2010-025951 filed on Feb. 8, 2010, the disclosure of which is expressly incorporated by reference herein in its entirety.

BACKGROUND OF THE INVENTION

1. Field of the Invention

The present invention relates to a reeding detection apparatus detecting existence of reeding provided to a peripheral surface. Specifically, the present invention relates to a coin sorting apparatus sorting a coin into a true coin or a false coin, based on existence of reeding provided to a peripheral surface, and more specifically, to a coin sorting apparatus sorting out a coin having reeding on a peripheral surface and having non-magnetic and strong conductive properties. Specifically, the present invention relates to a coin sorting apparatus sorting out a U.S. 25 cent coin. In the present specification, the term "coin" includes hard currencies, tokens, medals, and the like, and includes circular and polygonal shapes.

2. Description of Related Art

A U.S. 25 cent coin has a diameter of 24.26 mm and reeding on a peripheral surface. The coin has a commonly-called clad structure, in which a flat circular copper plate is coated with brass. Thus, the U.S. 25 cent coin has physically non-magnetic and strong conductive properties. An optical method is employed in conventional art in an apparatus detecting reeding on the peripheral surface (refer to Related Art 1).

[Related Art 1] Japanese Patent Laid-open Publication No. H9-167270 (FIGS. 1 and 2)

[Related Art 2] Japanese Patent Laid-open Publication No. H8-235407 (FIG. 3)

[Related Art 3] Japanese Patent Laid-open Publication No. H8-022564 (FIG. 1)

The conventional art employs an optical method, which requires a light projector/receiver, a comparison circuit, a computation circuit, and the like, thus leading to a high cost. Meanwhile, a credit card reading apparatus is widely used as a billing apparatus in the U.S., and a payment is generally made with a credit card. In case in which a user owns no credit card, a billing apparatus in an automated machine needs to be equipped with a billing apparatus for coins. In this case, the billing apparatus for coins is an ancillary billing apparatus, and thus the apparatus needs to be provided at a low cost, and yet at the same time, the apparatus should not accept a false coin. A coin sorting apparatus having an electric sensor is required to sort out a plurality of denominations, thus increasing cost and being unable to meet the low cost requirement. A mechanical coin sorting apparatus is preferable as a low cost billing apparatus, but the apparatus is able to sort out a single denomination alone. It is thus preferable that a mechanical coin sorting apparatus for 25 cent coins be selected in the U.S., as a mechanical coin sorting apparatus. A conventional mechanical coin sorting apparatus generally identifies mainly a diameter of coins at a high accuracy, and identifies a material and thickness at a low accuracy. The conventional mechanical coin sorting apparatus thus has a problem of accepting false coins formed of a low cost material and having the same diameter. It is then considered to detect reeding on peripheral surfaces of 25 cent coins. An photoelectric reeding detection apparatus is expensive, however, as described above, and thus the apparatus cannot be employed.

SUMMARY OF THE INVENTION

A first feature of the present invention is to provide a coin reeding detection apparatus at a low cost, the reeding being provided on a peripheral surface of a coin. A second feature of the present invention is to provide a coin sorting apparatus having a coin reeding detection apparatus at a low cost. A third feature of the present invention is to provide a coin sorting apparatus having a coin reeding detection apparatus at a low cost, the coin having non-magnetic and strong conductive properties. A fourth feature of the present invention is to provide a coin sorting apparatus surely capable of sorting out a coin having non-magnetic and strong conductive properties, even when the apparatus is tilted.

In view of the features above, a first aspect of the present invention provides a reeding detection apparatus configured as described below. Specifically, the first aspect provides a reeding detection apparatus detecting reeding of a coin having the reeding on a periphery thereof, the reeding detection apparatus including a detection body provided above a guide rail on which a coin rolls, and a detection sensor detecting a movement of the detection body, the detection body being movable in an extension direction of the guide rail and in a direction away from the guide rail, the detection body being provided with an end contactable with an upper end portion of a peripheral surface of the coin rolling on the guide rail, and retractable to an apex portion of the coin as being guided by the coin.

A second aspect of the invention provides the reeding detection apparatus according to the first aspect, in which the detection body is supported by guides provided above and below having a predetermined distance in between, and is supported retractably upward as being guided by an upper side peripheral surface of the coin rolling on the guide rail.

A third aspect of the invention provides the reeding detection apparatus according to the first aspect, in which the detection body has an elongated plate shape and is inclined approximately 30 degrees relative to an extension line of the guide rail.

A fourth aspect of the invention provides the reeding detection apparatus according to the third aspect, in which the detection body is provided with a plurality of elongated plate-shaped bodies having ends disposed displacing in the extension direction of the guide rail.

A fifth aspect of the invention provides a coin sorting apparatus having a reeding detection apparatus that detects reeding of a coin having the reeding on a periphery thereof and separates the coin as a true coin, the coin sorting apparatus including a detection body provided above a guide rail on which the coin inserted to an inlet rolls, and a sorting body positioned at a coin path provided downstream of the guide rail, the detection body being movable in an extension direction of the guide rail, the detection body being provided with an end contactable with an upper end portion of a peripheral surface of the coin rolling on the guide rail, the sorting body being moved to a sorting position of a true coin in conjunction with a movement of the detection body.

A sixth aspect of the invention provides the coin sorting apparatus having the reeding detection apparatus according to the fifth aspect. The detection body has an elongated plate shape, and is provided movably upward within a predetermined range in the extension direction of the guide rail and relative to the guide rail, by guides provided above and below in an intermediate portion. A rear end of the detection body is engaged with a receiving portion rotatably provided to a support axis. The receiving portion is connected so as to be moved in a predetermined direction when the end of the detection body is pressed by the reeding of the coin. The sorting body is provided, such that the sorting body is normally positioned at the coin path provided downstream of the end of the detection body so as to stop the coin from moving, and is moved to a position that does not stop the coin from moving in conjunction with a movement of the receiving portion. A release body is provided, such that the release body is normally positioned external to the coin path provided downstream of the sorting body, and is moved to the coin path in conjunction with a movement of the sorting body to the position that does not stop the coin from moving.

A seventh aspect of the invention provides the coin sorting apparatus having the reeding detection apparatus according to the sixth aspect, in which the receiving portion, the sorting body, and the release body are integrally provided projecting in a circumferential direction from a ring-shaped axis receiver rotatably supported to the support axis.

An eighth aspect of the invention provides a coin sorting apparatus having a reeding detection apparatus in which, of coins having non-magnetism and strong conductivity inserted to an inlet, a coin having authentic diameter and weight alone is turned laterally by a cradle and is guided to a moving path provided downstream of the cradle and provided with a pair of vertical standing guide surfaces; subsequently, the coin is guided and alternatively not guided in a predetermined direction by a moving guide slidable between the vertical standing guide surfaces; and thereby, the coin is sorted into a true coin and a false coin. The coin sorting apparatus includes a magnetic body provided downstream of the cradle and movable to a side of the moving path provided upstream of and opposite to the moving guide, from the cradle side toward the moving guide side along the moving path; and an interlocking mechanism interlocking the magnetic body and the moving guide. The moving guide advances to the moving path via the interlocking mechanism in association with a movement of the magnetic body from the cradle side toward the moving guide side along the moving path, and thereby guides the inserted coin to a coin path provided downstream. A plate-shaped detection body is provided movable above the moving guide in an extension direction of the moving guide; an end of the detection body is provided contactable with an upper end portion of a peripheral surface of the coin rolling on the guide rail; and a sorting body positioned at the coin path provided downstream of the moving guide is moved to a sorting position for the true coin in conjunction with a movement of the detection body.

A ninth aspect of the invention provides the coin sorting apparatus having the reeding detection apparatus according to the fifth to eighth aspects, in which the detection body is provided with a plurality of elongated plate-shaped bodies having ends disposed displacing in the extension direction of the guide rail.

In the first aspect of the invention, the end of the detection body collides with the upward arcuate peripheral surface on the upper side of the coin rolling on the guide rail at a predetermined angle. When there is reeding on the peripheral surface of the coin, the end of the detection body hooks into the reeding, and then the detection body is pressed in the rolling direction of the coin. The press moves the detection body in the rolling direction of the coin (extension direction of the guide rail) and the direction away from the guide rail. The end of the detection body is thus retracted from an area in which the coin rolls. Thereby, a true coin having reeding rolls on the guide rail, and is received as a true coin. When there is no reeding on the peripheral surface of the coin, the end of the detection body does not hook into the peripheral surface of the coin, even when the end of the detection body contacts with the peripheral surface of the coin. The end of the detection body slides along the peripheral surface and climbs over the apex portion of the coin. In other words, the detection body is moved only in the direction away from the guide rail, and is not moved in the rolling direction of the coin (extension direction of the guide rail). Specifically, the movement of the detection body is not detected by the detection sensor. Thus, when the movement of the detection body in the extension direction of the guide rail is detected by the detection sensor, it can be detected whether the coin has reeding on the peripheral surface. The reeding detection apparatus has a simple structure having the detection body and the detection sensor, and thus production cost is low.

In the second aspect of the invention, the detection body is movable by the guides provided above and below the detection body, in the extension direction of the guide rail and the direction away from the guide rail in an orthogonal direction thereto. Since the structure of the guides is simple, production cost is low.

In the third aspect of the invention, the detection body, which has an elongated plate-shaped body, is easy to be produced at a low cost. In addition, providing the detection body inclined at 30 degrees relative to the extension line of the guide rail of the coin achieves both a hook into reeding and a sliding contact, and thus production cost is low.

In the fourth aspect of the invention, the detection body is provided with a plurality of elongated plate-shaped bodies having ends disposed displacing in the extension direction of the guide rail. Thus, even when the end of the first detection body does not hook into the reeding, the end of the next detection body hooks, thus improving an accuracy of reeding detection.

In the fifth aspect of the invention, the sorting body is normally positioned at the coin path provided downstream of the detection body, and stops the coin from moving. In other words, unless the detection body is moved in the rolling direction of the coin, the coin is stopped from rolling by the sorting body, and is not received as a true coin. When the detection body is moved by the reeding of the coin in the rolling direction of the coin, the sorting body is retracted from the coin path in conjunction with the movement. Thus, the coin can roll more downstream than the sorting body. As described above, a false coin having no reeding is stopped from rolling by the sorting body, and a true coin having reeding can roll without being stopped by the sorting boy. Thereby, the true coin and the false coin can be sorted out based on the existence of reeding. Further, the reeding detection apparatus has a simple structure having the detection body and the detection sensor, and thus the coin sorting apparatus can be produced at a low cost.

In the sixth aspect of the present invention, the rear end of the detection body is engaged with the receiving portion. In other words, when the detection body is moved as it hooks into the reeding of the coin, the receiving portion is also moved. The sorting body is normally positioned at the coin path provided downstream of the end of the detection body, and stops the coin from moving. The sorting body is retracted from the coin path in conjunction with the movement of the receiving portion. In other words, when the detection body is moved as it hooks into the reeding of the coin, the sorting body is retracted from the coin path, and thus the true coin having reeding can pass through the sorting body and move. The release body provided on the coin path downstream of the sorting body slides to and from the coin path with an opposite phase of the sorting body. Specifically, the release body is normally retracted from the coin path. When the sorting body is retracted from the coin path, the release body is advanced to the coin path. In other words, when the detection body hooks into the reeding of the coin and is moved, the release body is advanced to the coin path. Then, the release body is pressed as the coin moves, and thus is retreated from the coin path. Specifically, the detection body and the sorting body are returned to the normal positions and enter standby mode. Thereby, the detection body and the sorting body can be returned to the standby positions with no electric actuator used, and thus the coin sorting apparatus can be produced at a low cost.

In the seventh aspect of the invention, the receiving portion, the sorting body, and the release body are integrally provided to the same ring-shaped axis receiver. With the simple structure, the coin sorting apparatus can be produced at a low cost.

In the eighth aspect of the invention, when a coin having non-magnetism and strong conductivity is inserted to the inlet, the coin is sorted out by the cradle based on the diameter and weight. Specifically, a false coin having a small diameter drops below since the coin is not supported by the cradle. A false coin not having a predetermined weight is separated as a false coin since the coin cannot rotate the cradle. A true coin is supported by the cradle and exerts a predetermined moment on the cradle. Thus, the cradle is turned in the lateral direction, and the true coin supported by the cradle is moved to the moving path provided downstream of the cradle, the moving path having a pair of vertical standing guide surfaces standing in parallel having a distance slightly wider than the thickness of the coin so as to guide the side surface of the coin. The true coin rolls on the fixed guide rail, which is inclined front downward, in the moving path. An internal electromotive force is generated in a strong conductive material portion of the true coin rolling on the fixed guide rail, by the magnetic force from the magnetic body provided on the side, and thus an eddy current is caused. The eddy current generates an electromagnetic force around the true coin. The electromagnetic force and the magnetic force of the magnetic body repel each other. As a result, the magnetic body receives repulsion from the true coin generating the electromagnetic force, and is pressed away as the true coin moves. In other words, the magnetic body is moved slightly ahead of the true coin in the same moving direction as the true coin. The movement of the magnetic body in the same moving direction as the true coin moves the moving guide rail to downstream of the fixed guide rail via the interlocking mechanism. Thus, the true coin rolls on the moving guide rail subsequent to the fixed guide rail, and is received as a true coin. A false coin having the same diameter and weight as the true coin and having magnetism, is attracted by the magnetic body and held on the moving path. Since the false coin is unable to move to the moving guide rail, the false coin is separated. A false coin having the same diameter and weight as the true coin and having a weak/medium conductivity, has a small internal electromotive force, hence a small magnetic force generated. Thus, the magnetic body is not moved by the rolling false coin for more than a predetermined amount. Accordingly, the moving guide rail is not moved to the guide position of the moving path via the interlocking mechanism. In this case, the coin drops at a position to which the moving guide rail is supposed to be advanced, and is thus separated as a false coin. In addition, the sorting body is normally positioned at the coin path provided downstream of the moving guide rail, and stops the coin from moving. In other words, when the detection body is not moved in the rolling direction of the coin, the coin is stopped from rolling by the sorting body, and is not received as a true coin. When the detection body is moved in the rolling direction of the coin by the reeding of the coin, the sorting body is retracted from the coin path in conjunction with the movement. In other words, the coin can roll more downstream than the sorting body. Thereby, the false coin having the same diameter and material but having no reeding, is stopped from rolling by the sorting body, while the true coin having reeding can roll without being stopped by the sorting body. Thus, the true coin and the false coin can be sorted out based on the existence of reeding. Further, the reeding detection apparatus has a simple structure having the detection body and the detection sensor, and thus the coin sorting apparatus can be produced at a low cost.

In the ninth aspect of the invention, the detection body is provided in plurality. Thus, chances of the ends of the detection bodies hook into the reeding are increased a plurality of times, thus improving an accuracy of reeding detection.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

Figure 1:
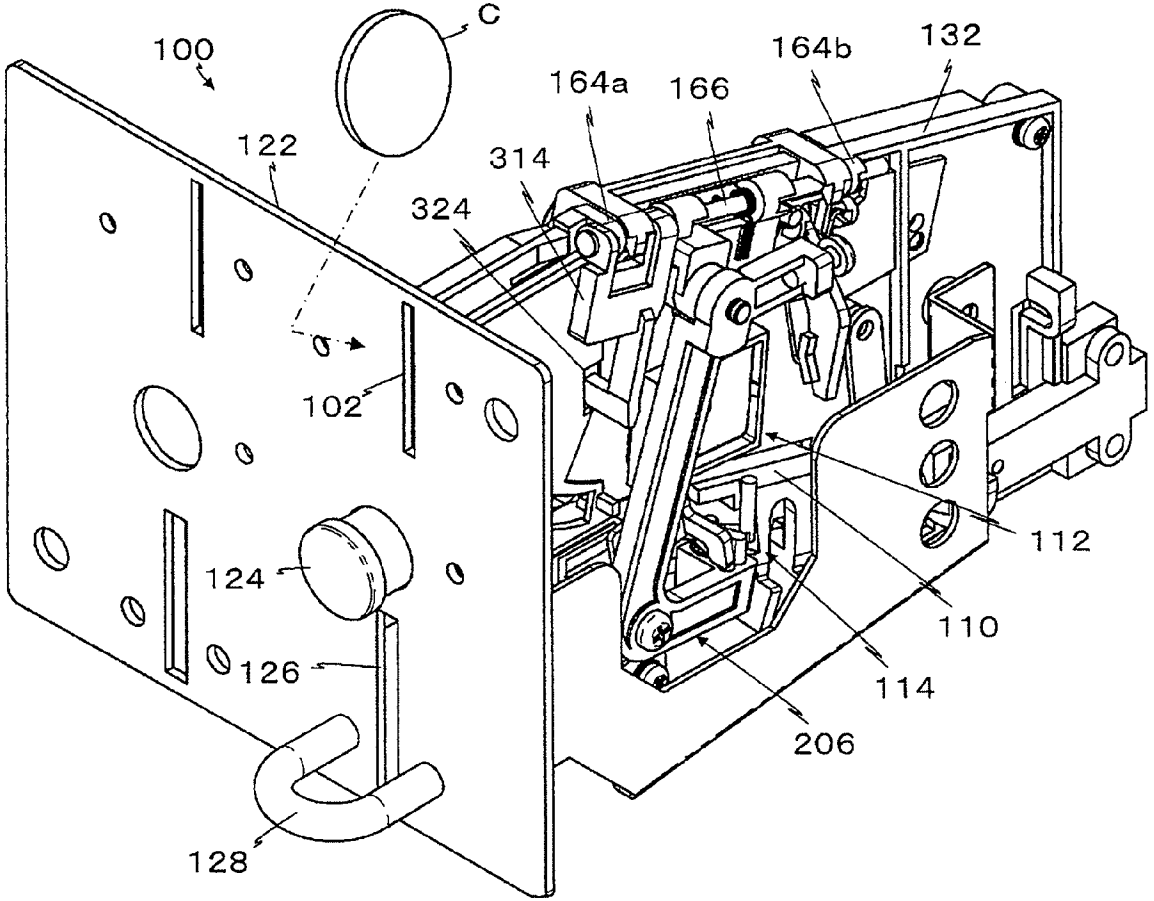
FIG. 1 is a perspective view from upper front right of a coin sorting apparatus according to a third embodiment of the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

First Embodiment

A present first embodiment targets U.S. 25 cent coins as coins having reeding on peripheral surfaces. In the present embodiment, a coin sorting apparatus 100 is mounted with a reeding detection apparatus 120 of the present invention, the coin sorting apparatus 100 sorting 25 cent coins into true coins and false coins. Since U.S. 25 cent coins have a structure in which copper is cladded by brass, the coins are non-magnetic and strongly conductive. The target coins are, however, not limited to coins C, and may include substitute coins having a similar structure, such as tokens and the like. In the present specification, "coins" thus also refer to tokens, medals, and the like, in addition to hard currencies.

The coin sorting apparatus 100 has at least an inlet 102 for the coins C, a cradle 104, a moving path 106 for the coins C, a fixed guide rail 108, a moving guide rail 110, a magnetic body 112, an interlocking mechanism 114, a true coin slot 116, a true coin sensor 118, and a reeding detection apparatus 120. Further, it is preferable to have a sorting body 121 of the coins C and a release body 277.

The reeding detection apparatus 120 is first explained mainly with reference to FIGS. 5, 17A, 17B, and 20 to 24. The reeding detection apparatus 120 detects reeding G (refer to FIG. 17B) provided to a peripheral surface of a true coin TC. The reeding detection apparatus 120 in the first embodiment has at least a detection body 256 formed of a stick-shaped body, and a detection sensor 257.

Figure 5:
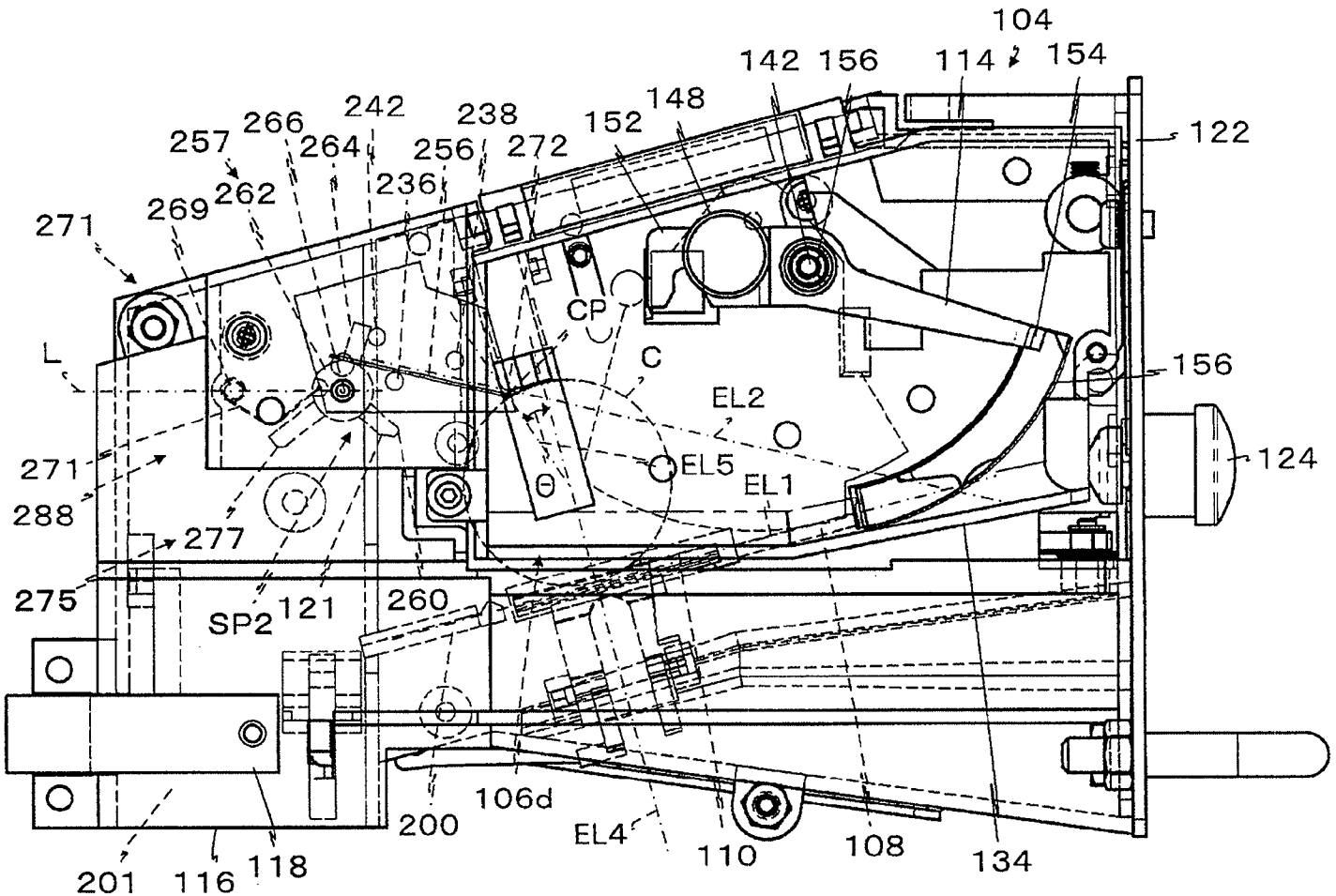
FIG. 5 is a left side view of the coin sorting apparatus according to the third embodiment of the present invention.

The detection body 256 in the first embodiment has an elongated plate shape formed of a thin metal plate. A rear end portion 258 thereof is engaged with a receiving portion 264 projecting in a circumferential direction from an axis receiver 262. As shown in FIG. 5, a rectangular engagement hole 270 is provided to the rear end portion 258 of the detection body 256. The receiving portion 264 passes through the engagement hole 270. Specifically, the receiving portion 264 passes through the engagement hole 270 having a slight amount of play, thus allowing the detection body 256 to approach and separate from the moving guide rail 110 hereinafter described within a predetermined range, and to move in a rolling direction of the coin C (extension direction of the guide rail 110). The receiving portion 264 is a cross-sectionally rectangular stick-shaped body.

The detection sensor 257 has the receiving portion 264 and the axis receiver 262. The detection sensor 257 detects a movement of the detection body 256 along the moving guide rail 110. To provide functions to detect the movement of the detection body 256 and to activate other component elements, a mechanical sensor, an electric sensor, or an optical sensor may be employed. In the present first embodiment, a mechanical sensor is employed that converts a linear movement of the detection body 256 into a rotation movement of the axis receiver 262 through the receiving portion 264, and thus detects the movement of the detection body 256 and relays the rotation of the axis receiver 262 to a movement of the sorting body 121 hereinafter described. When an electric sensor is employed, it is thus necessary to electrically detect the movement of the detection body 256 and to move the sorting body 121 to a predetermined position. The axis receiver 262 has a round ring shape and is rotatably supported by a third fixing axis 266 laterally projecting from a main body plate 132 hereinafter described. The axis receiver 262 is integrally provided with the sorting body 121 and a release apparatus 275.

An intermediate portion of the detection body 256 is placed on an upper surface of a first projection 236 laterally projecting from the main body plate 132. An upper surface of the detection body 256 is supported by a second projection 238 and a third projection 242. The detection body 256 is thus provided movable in an extension direction thereof within a predetermined range. In other words, the detection body 256 is movable in a rolling direction of the coin C on the moving guide rail 110, and in a direction away from the moving guide rail 110. An end 272 of the detection body 256 is disposed, such that the end 272 contacts with the peripheral surface of the coin C on the moving guide rail 110 at a predetermined angle. The predetermined angle refers to an angle at which the end 272 of the detection body 256 hooks into a groove GC of the reeding G of the true coin TC; the detection body 256 is moved in the extension direction thereof by a movement of the true coin TC; and the axis receiver 262 is rotated counterclockwise in FIG. 17A. It is proven in experiments that the angle is preferably an angle at which an extension line EL1 of the moving guide rail 110 and an extension line EL2 of the detection body 256 intersect at approximately 30° for U.S. 25 cent coins. Specifically, it is preferable that a contact (collision) of the end 272 and the peripheral surface of the coin C be made at an angle θ of approximately 20° formed by a linear line EL4 and a linear line EL5, the linear line EL4 passing through the center of the coin C and orthogonally intersecting the moving guide rail 110, the linear line EL5 connecting the center of the coin C and a contact point CP with the end 272. When the angle of the detection body 256 and the peripheral surface of the true coin TC is narrow, the detection body 256 is flipped up by the peripheral surface of the true coin TC even if the end 272 is engaged with the groove GC, and thus unable to be moved in the extension direction thereof. When the angle is wide, the detection body 256 is pressed downward and thus unable to be moved in the extension direction thereof. The collision angle of the detection body 256 and the coin C may be set based on a weight of the detection body 256, a diameter of the coin C, a pitch and height (depth of the groove GC) of the reeding G.

The sorting body 121 is explained below mainly with reference to FIG. 5. The sorting body 121 is normally positioned at the moving path 106, more specifically, at a coin path 106*d* provided downstream of the end 272 of the detection body 256, and stops the true coin TC from rolling, the true coin TC rolling on a second fixed guide rail 200. When the reeding detection apparatus 120, or the detection body 256 is moved by the reeding G of the true coin TC in the extension direction of the moving guide rail 110, the sorting body 121 is retracted from the coin path 106*d*, thereby allowing the true coin TC to move to the true coin slot 116.

The coin sorting body 121 has a stick-shaped body projecting from the axis receiver 262 in the circumferential direction. An end 260 of the sorting body 121 is normally positioned orthogonal to a tangent of the true coin TC on the second fixed guide rail 200. Specifically, an extension line EL3 of the end 260 of the sorting body 121 is directed to the center of the coin C which is guided by the second guide rail 200 (refer to FIG. 24). The position is a position at which the receiving portion 264 is engaged with the third projection 242. Thus, when the receiving portion 264 is moved by the detection body 256, and the axis receiver 262 is rotated clockwise in FIG. 5, the sorting body 121 is retracted from the coin path 106*d*, thereby allowing the true coin TC to move (refer to FIGS. 21 to 23). When the detection body 256 is not moved in the extension direction on the contrary, the axis receiver 262 is not rotated, and thus the sorting body 121 remains stopped on the coin path 106*d*. The end 260 then stops the coin C from moving, more specifically from rolling on the second fixed guide rail 200 (refer to FIG. 24). In this case, even the true coin TC is stopped from rolling by the sorting body 121. The coin C, which is stopped from rolling, is retained on the coin path 106*d*. When a cancel button 124 is pressed to move a cancel door 134 to a cancel position CP, the true coin TC is not held on the coin path 106*d*, and is dropped to a cancel path 222 and then returned to a return slot 126.

Figures 17A, 17B:
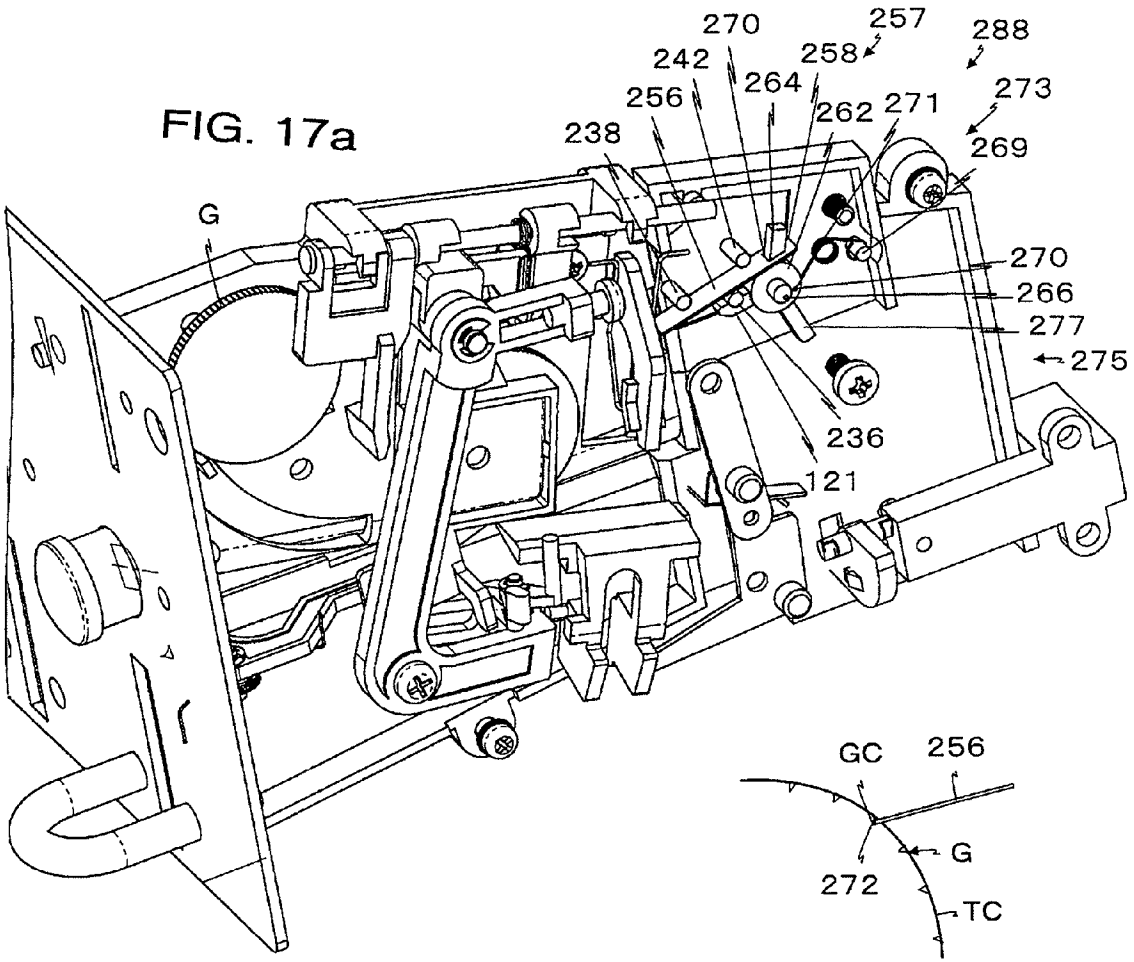
FIGS. 17A and 17B are perspective views of a reeding detector of the coin sorting apparatus according to the third embodiment of the present invention.
Figure 18:
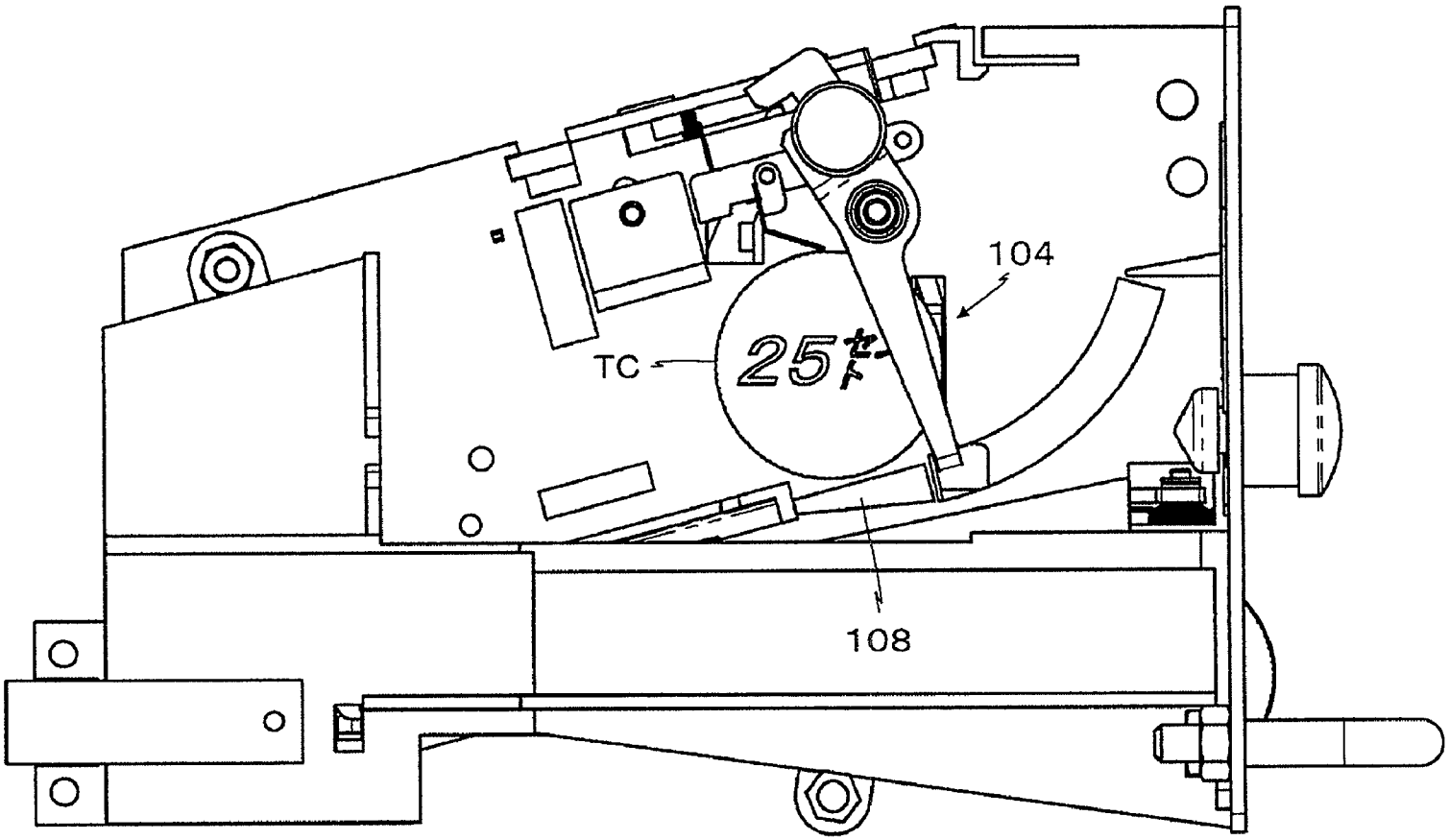
FIG. 18 illustrates an operation of the coin sorting apparatus according to the third embodiment of the present invention, immediately after a true coin passes through the cradle.
Figure 19:
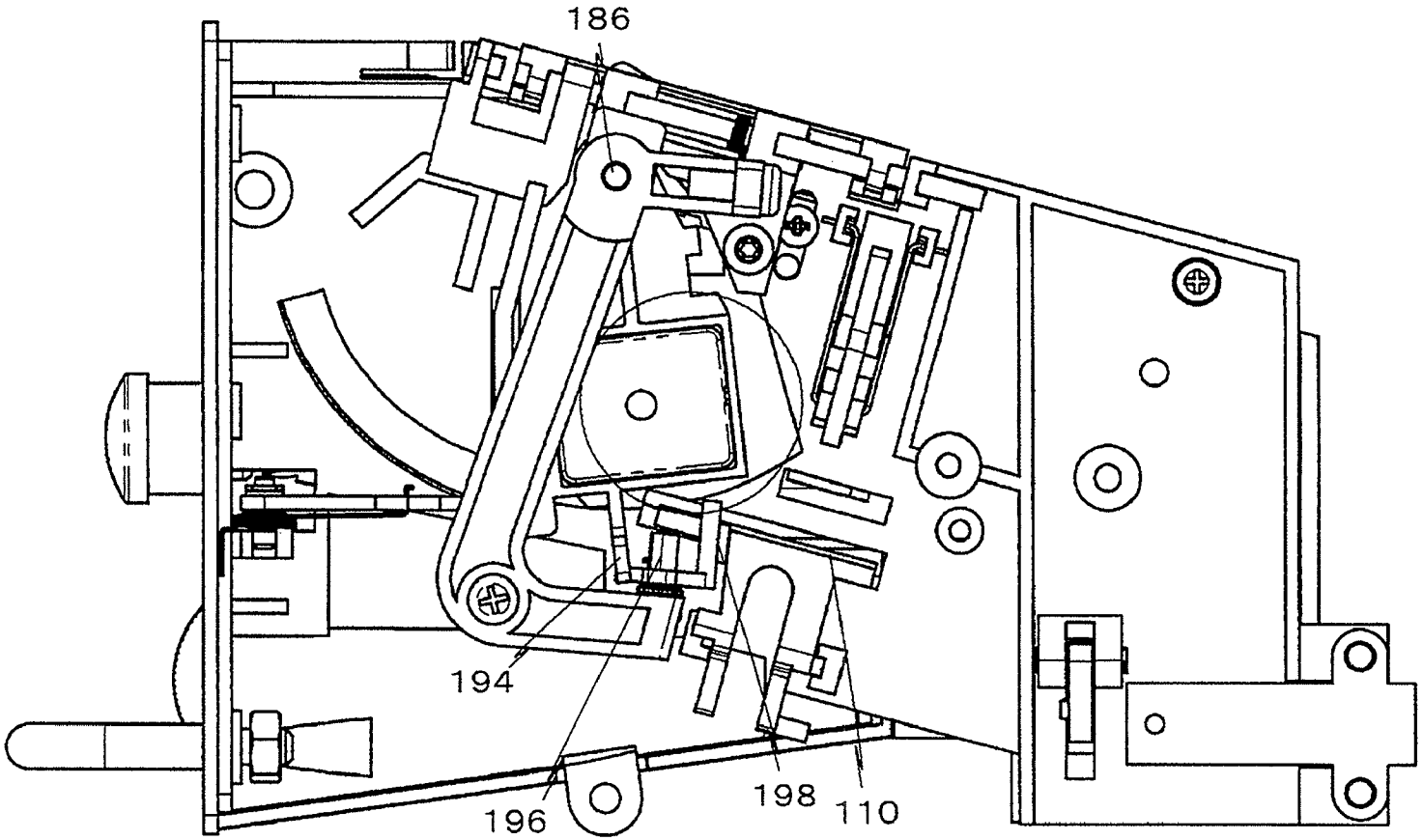
FIG. 19 illustrates an operation of the coin sorting apparatus according to the third embodiment of the present invention, after the coin sorting apparatus is tilted.
Figure 20:
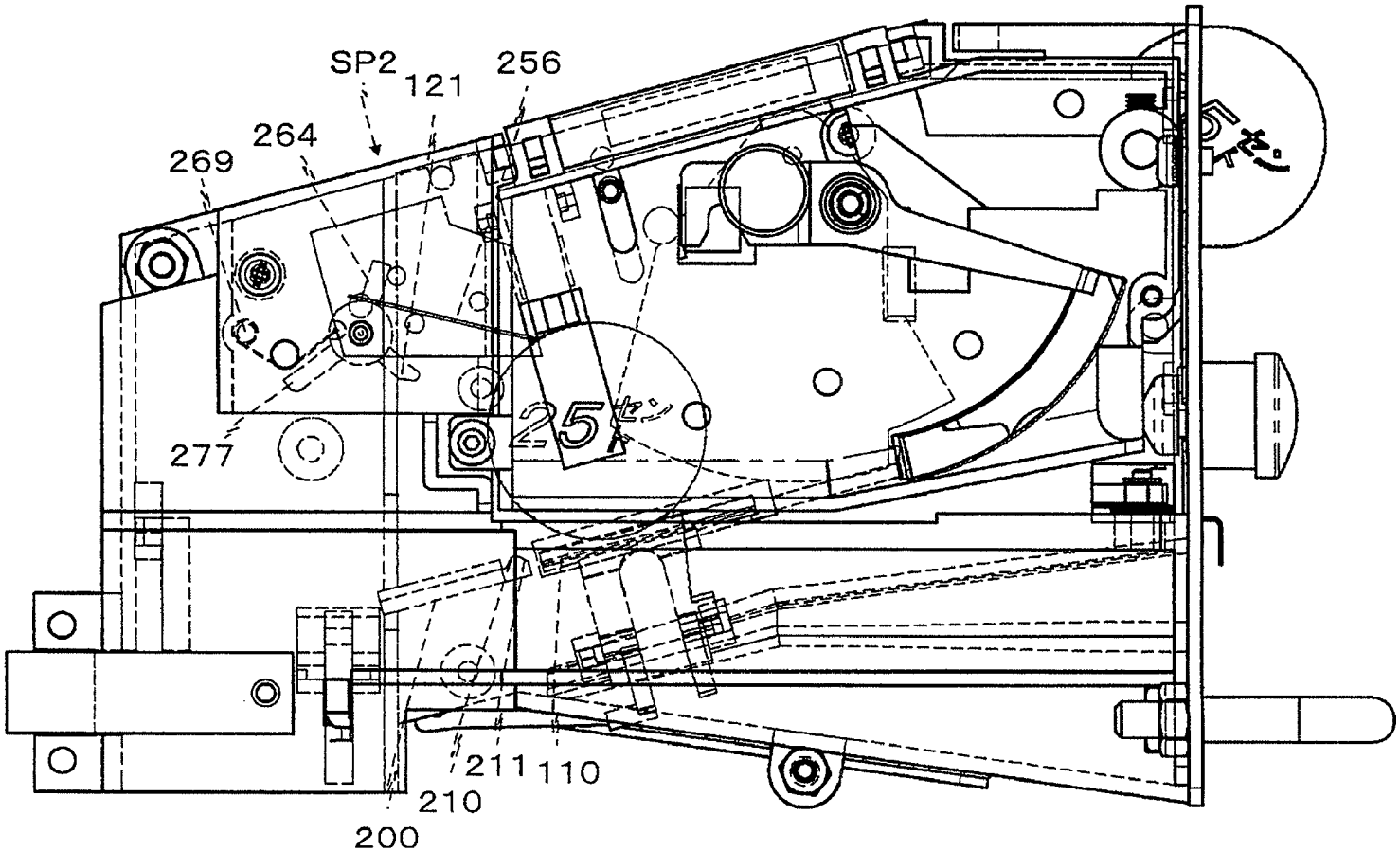
FIG. 20 is a left side view of a reeding detection apparatus according to a first embodiment and a coin sorting apparatus having the reeding apparatus.
Figure 21:
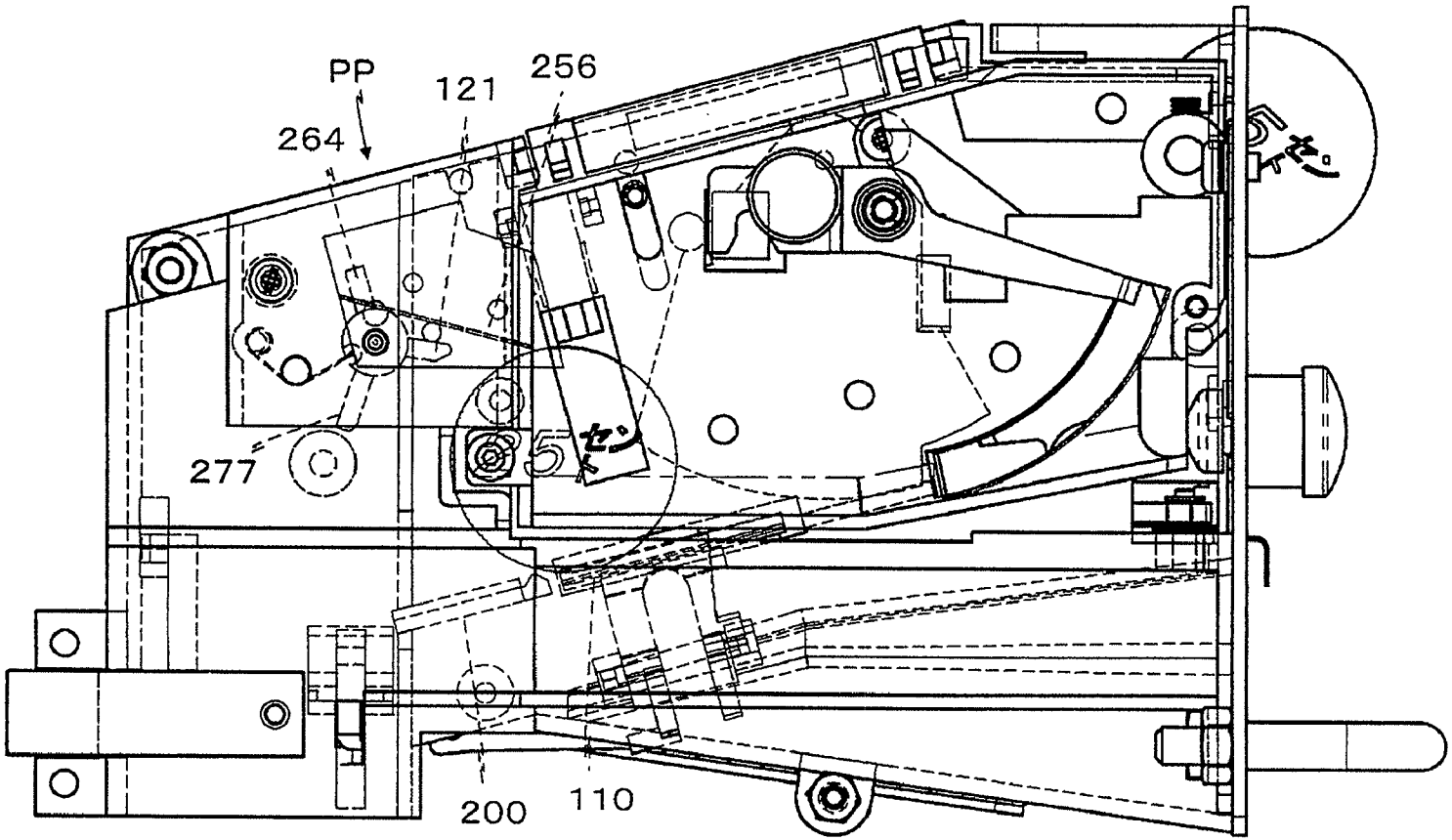
FIG. 21 is a left side view of the reeding detection apparatus according to the first embodiment and the coin sorting apparatus having the reeding apparatus (in case of a true coin)
Figure 22:
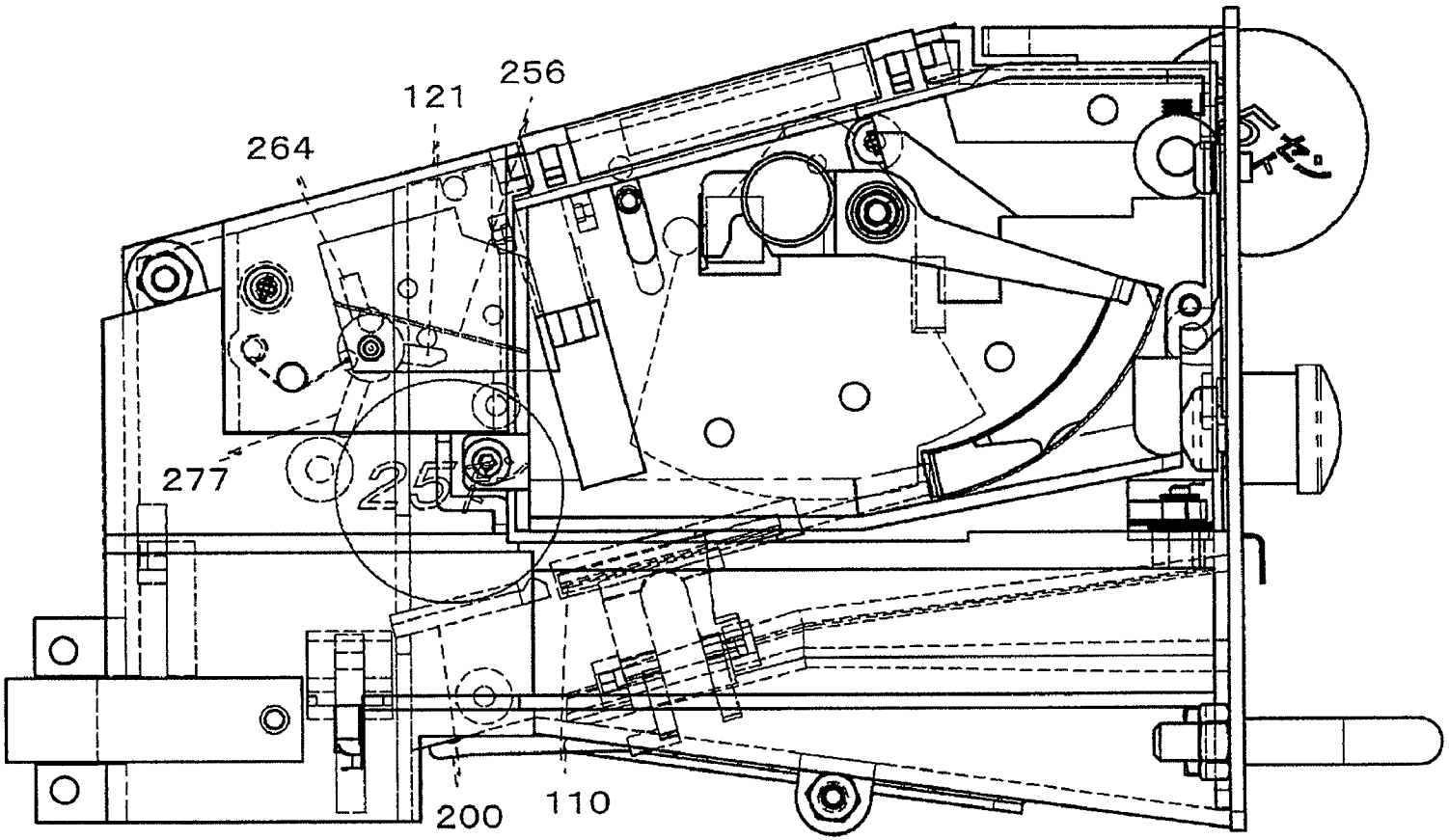
FIG. 22 is a left side view of the reeding detection apparatus according to the first embodiment and the coin sorting apparatus having the reeding apparatus (in case of a true coin)
Figure 23:
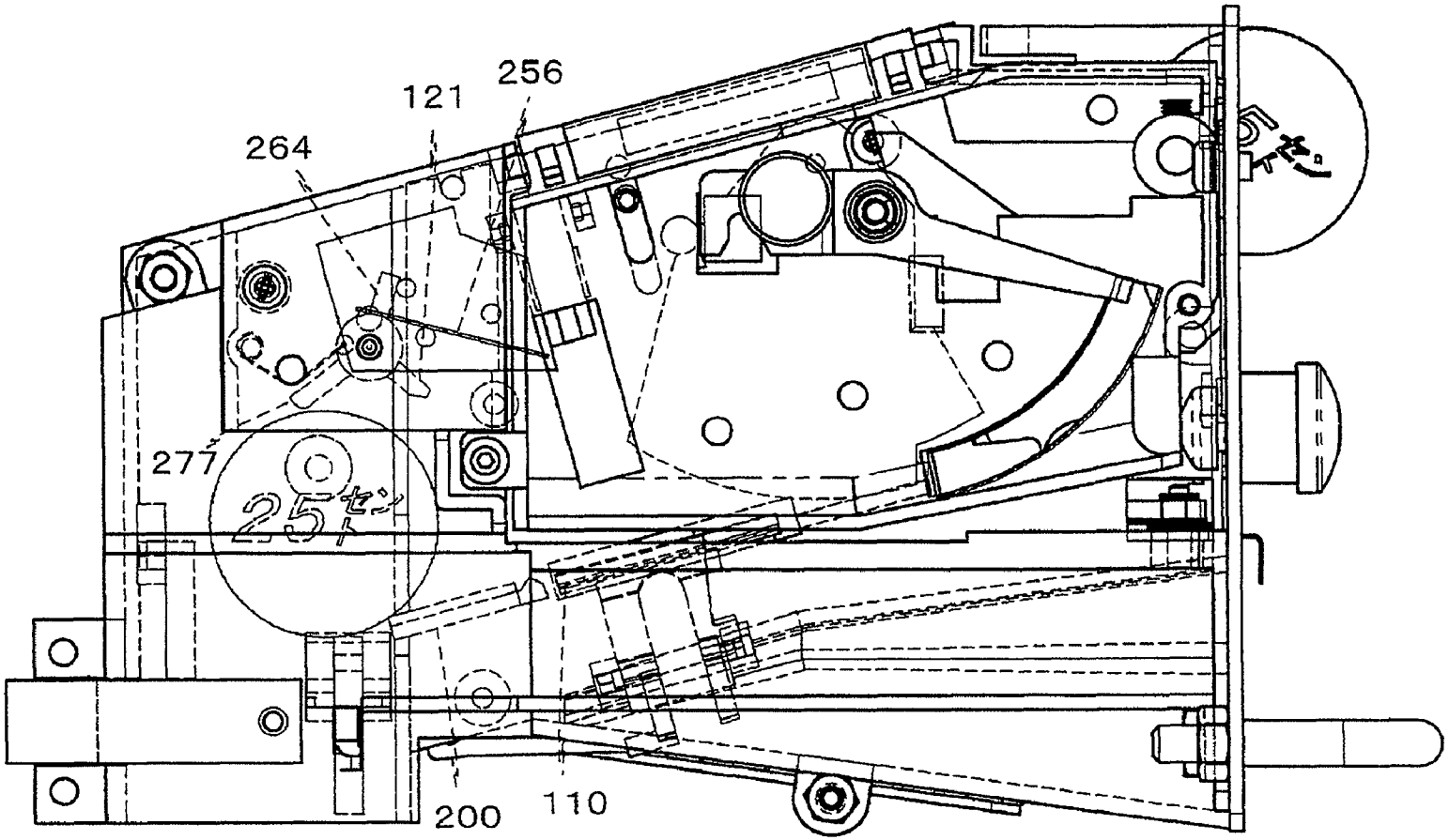
FIG. 23 is a left side view of the reeding detection apparatus according to the first embodiment and the coin sorting apparatus having the reeding apparatus (in case of a true coin)

A holding apparatus 288 of the sorting body 121 is explained below with reference to FIGS. 5, 17A, and 17B. The holding apparatus 288 holds the sorting body 121 at a stop position SP2 or a pass position PP (refer to FIG. 21). In the present first embodiment, the holding apparatus 288 is a snap-action mechanism 273 having a spring 271 provided with a first end portion and a second end portion, the first end portion engaged with a cylindrical pin 269 laterally projecting from the main body plate 132, the second end portion engaged with the engagement hole 270 provided to an end surface of the axis receiver 262. Specifically, when the receiving portion 264 is engaged with the third projection 242, as shown in FIG. 5, the engagement hole 270 is provided to be positioned closer to the receiving portion 264 side than a line L connecting the pin 269 and the center of the third fixed axis 266. Since a biasing force of the spring 271 is thus exerted clockwise on the axis receiver 262, the receiving portion 264 is continuously engaged with the third projection 242, and the sorting body 121 is held at the stop position SP2. When the axis receiver 262 is rotated counterclockwise, the sorting body 121 is engaged with the first projection 236, and the engagement hole 270 is provided to be positioned closer to the sorting body 121 side than the line L. Since the biasing force of the spring 271 is thus exerted counterclockwise on the axis receiver 262, the sorting body 121 is continuously engaged with the first projection 236, and the sorting body 121 is held at the pass position PP. Although the spring 271 is illustrated upside down in FIGS. 20 to 24 relative to FIGS. 17A and 17B, the spring 271 functions similarly even when a vertical relationship is reversed.

The holding apparatus 288 has the release apparatus 275. The release apparatus 275 returns the sorting body 121 from the pass position PP to the second stop position SP2. The release apparatus 275 is the stick-shaped release body 277 projecting in the circumferential direction of the axis receiver 262 which is provided between the receiving portion 264 and the sorting body 121. When the sorting body 121 is positioned at the second stop position SP2, the release body 277 is disengaged from the coin path 106*d*, more specifically retracted above the coin path 106*d*. When the sorting body 121 is positioned at the pass position PP, the release body 277 is positioned to the coin path 106*d*. With the structure above, when the sorting body 121 is positioned at the pass position PP, the true coin TC, which rolls on the second fixed guide rail 200 and passes therebelow, presses the release body 277. The axis receiver 262 is thus rotated clockwise in FIG. 5, then allowing the true coin TC to pass. The rotation of the axis receiver 262 moves the sorting body 121 from the pass position PP to the second stop position SP2, and then back to standby mode. Similarly, the receiving portion 264 is also rotated clockwise, and the end 272 of the detection body 256 is also positioned to the coin path 106*d*. In other words, the detection body 256 is returned to a standby position SP.

Operations of the reeding detection apparatus 120 of the first embodiment are explained below with reference to FIGS. 20 to 24. In a process in which the true coin TC rolls on the moving guide rail 110, the reeding G is detected by the reeding detection apparatus 120. Specifically, the end 272 of the detection body 256 hooks into the groove GC of the reeding G, and then the detection body 256 is pressed to the left in FIG. 5, or in the extension direction of the moving guide rail 110 (refer to FIG. 20). When the end 272 does not hook into the reeding G at the first contact, the next groove of the reeding G is contacted with the end 272 as the coin C rolls, and is hooked. When the end 272 does not hood into the reeding G, the angle of the end 272 and the coin C is gradually close to the tangent of the coin C, and thus the depth of the groove GC is gradually shallow relative to the end 272. It is thus difficult to be hooked, and the coin C is not hooked at all around an apex thereof and thus rolls. Thereby, the sorting body 121 is continuously positioned at the second stop position SP2. Thus, even the true coin TC is stopped from rolling by the sorting body 121, and sorted as a false coin FC and returned to the return slot 126, hereinafter described.

When the end 272 hooks into the groove GC, the detection body 256 is moved in the extension direction of the moving guide rail 110 (rolling direction of the coin C), as being guided by the first projection 236, the second projection 238, and the third projection 242. Then, the detection body 256 rotates the axis receiver 262 counterclockwise in FIG. 5, by way of the receiving portion 264. In the process, the extension direction of the moving guide rail 110 (rolling direction of the coin C) and the moving direction of the detection body 256 do not completely coincide. When the direction is to the left in FIG. 17, however, the direction is referred to as the same direction. The rotation rotates the axis receiver 262 until the sorting body 121 is engaged with the first projection 236, and thus the position is continuously held by the holding apparatus 288. As a result, the end 272 of the detection body 256 is moved outside the coin path 106*d*; the sorting body 121 is moved to the pass position PP; and the release body 277 is positioned to the coin path 106*d* (refer to FIG. 21). In other words, the detection body 256 is retractable above the coin C (coin path 106*d*). Since the sorting body 121 is moved to the pass position PP, the coin C is moved (rolls) from the moving guide rail 110 to the second fixed guide rail 200. The true coin TC rolling on the second fixed guide rail 200, rolls while pressing the release body 277; rotates the axis receiver 262 from the position in FIG. 22 to the position in FIG. 23, and thus passes; and drops to a vertical standing path 201 (refer to FIG. 23). The rotation of the axis receiver 262 returns the receiving portion 264, the sorting body 121, and the release body 277 to the position in FIG. 5. Specifically, the detection body 256 is returned to the standby position SP, and the sorting body 121 is returned to the second stop position SP2.

Figure 24:
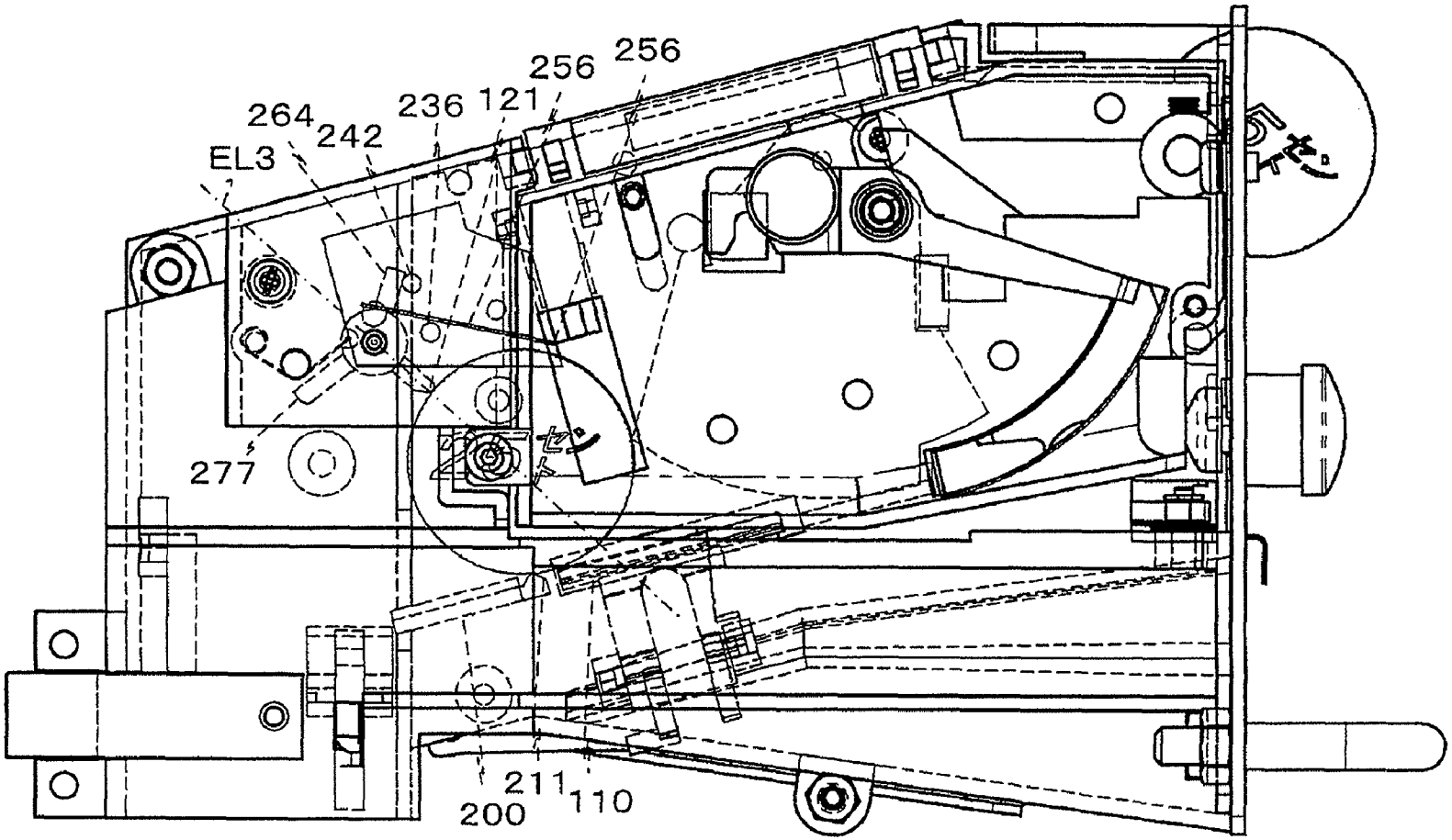
FIG. 24 is a left side view of the reeding detection apparatus according to the first embodiment and the coin sorting apparatus having the reeding apparatus (in case of a false coin)

When the coin C has no reeding G, the end 272 does not hook into the groove GC, and thus the detection body 256 merely slips up to the apex of the coin C along the peripheral surface thereof (refer to FIG. 24). Since the detection body 256 is not moved in the rolling direction of the coin in this case, the receiving portion 264 is not moved. Thus, the axis receiver 262 is not rotated, and the sorting body 121 is held on the coin path 106*d*. As a result, the coin C is stopped from moving on the coin path 106*d* by the sorting body 121. In the state in which the coin C is stopped from moving by the sorting body 121, the coin C is positioned on a front upward inclined surface 211 hereinafter described, and distant from the moving guide rail 110. Thereby, the moving guide rail 110 returns to the standby position SP by self moment, as described hereinafter. Thus, the coin C rolls to the inlet 102 side due to inclination of the front upward inclined surface 211. Since the moving guide rail 110 does not exist, the coin C drops to the cancel path 222 hereinafter described, and then is returned to the return slot 126 hereinafter described. In other words, the false coin FC having no reeding G on the peripheral surface is separated from the true coin TC.

Second Embodiment

Figure 25:
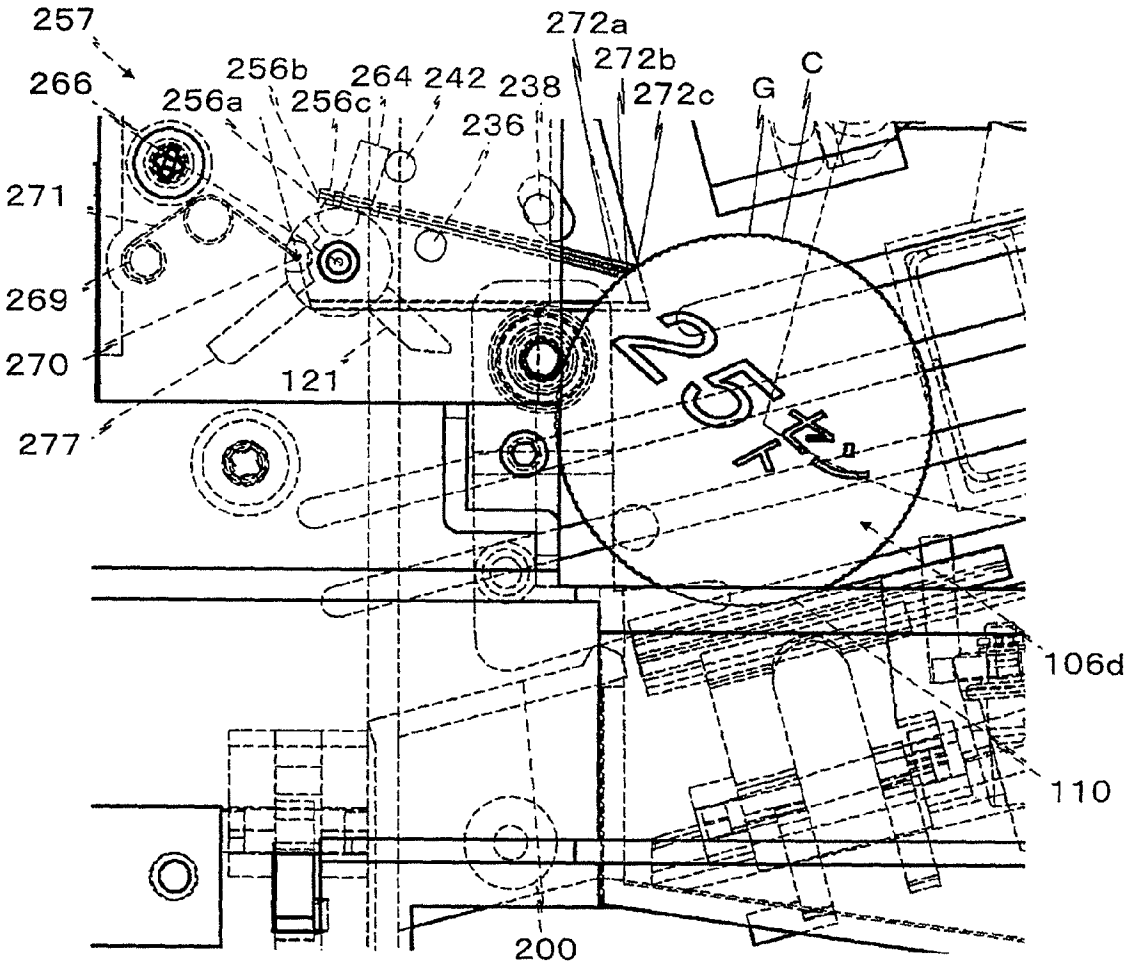
FIG. 25 is an enlarged view of a reeding detection apparatus according to a second embodiment for illustration (when collided)
Figure 26:
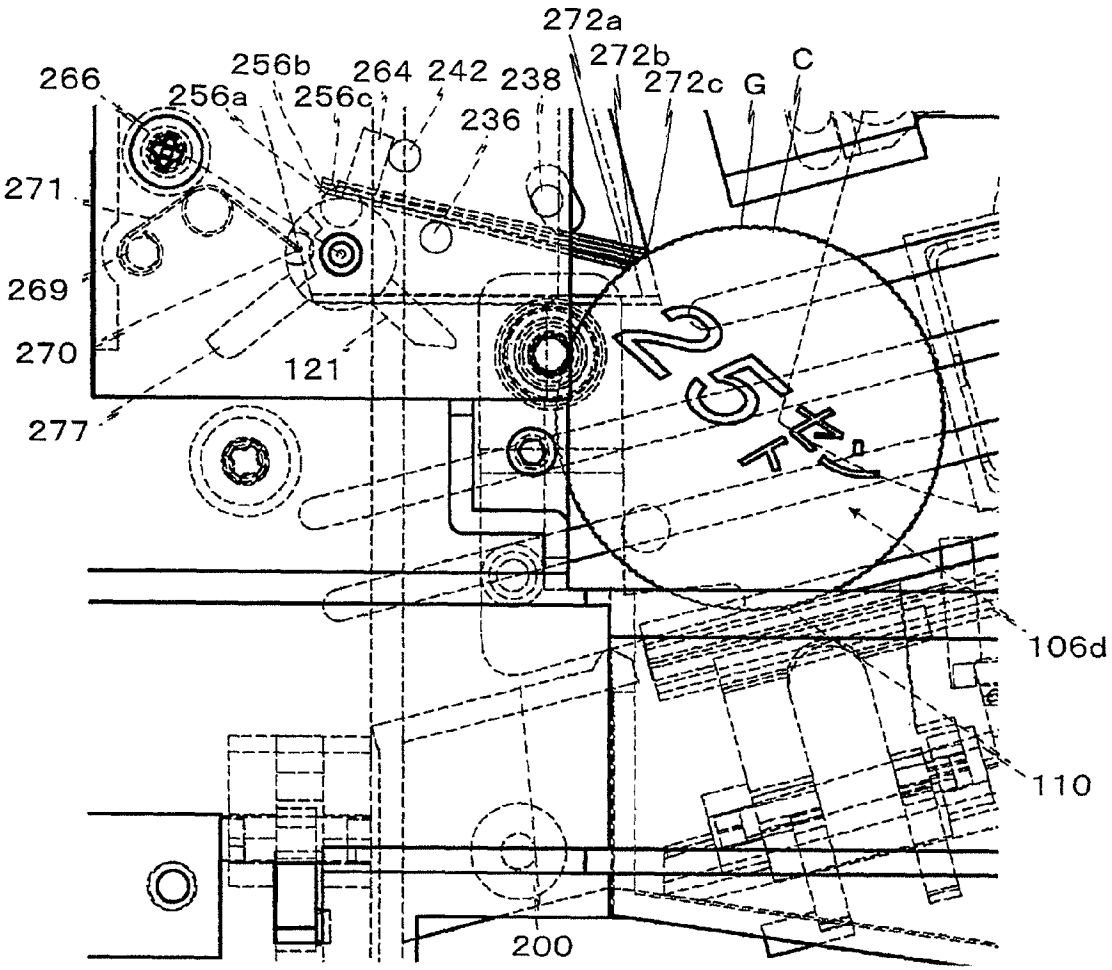
FIG. 26 is an enlarged view of the reeding detection apparatus according to the second embodiment for illustration (when collided)
Figure 27:
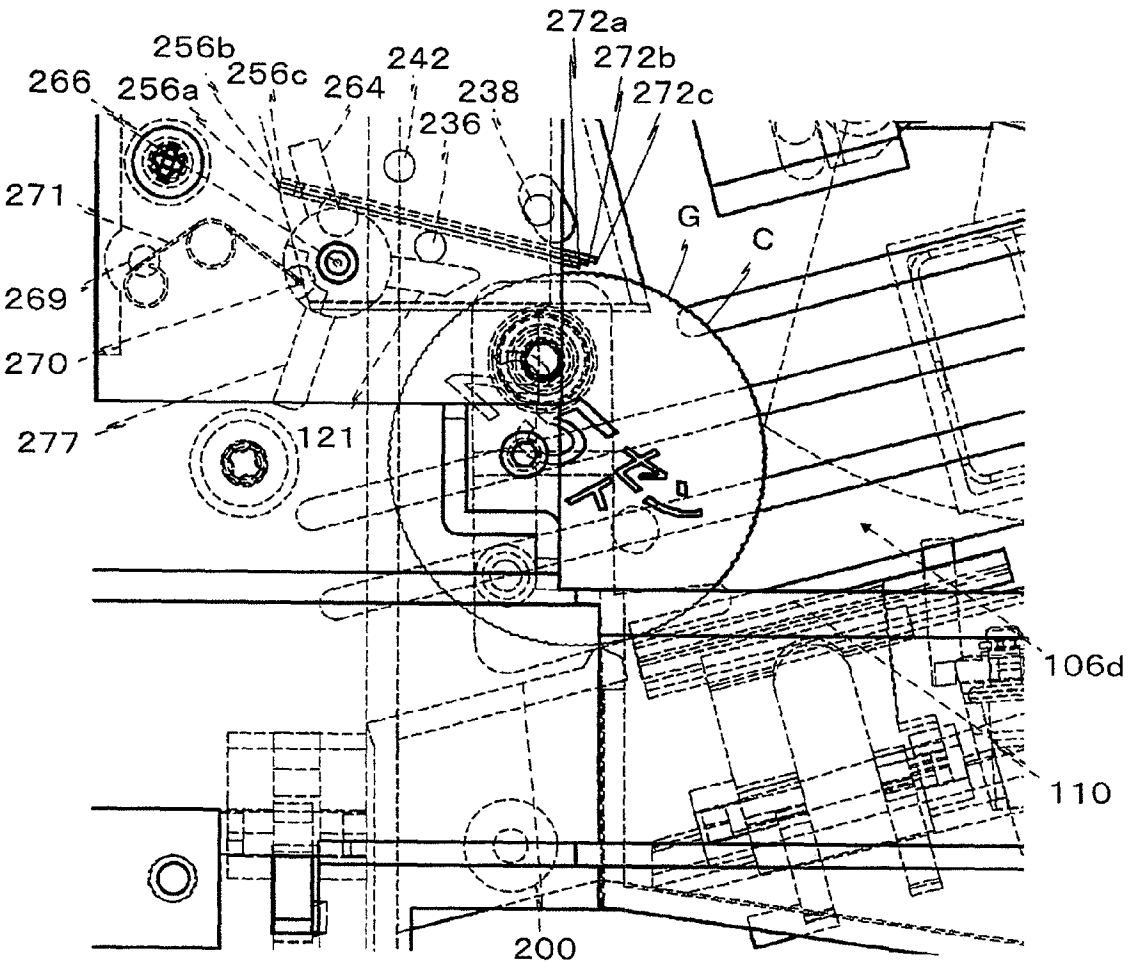
FIG. 27 is an enlarged view of the reeding detection apparatus according to the second embodiment for illustration (in case of a true coin)
Figure 28:
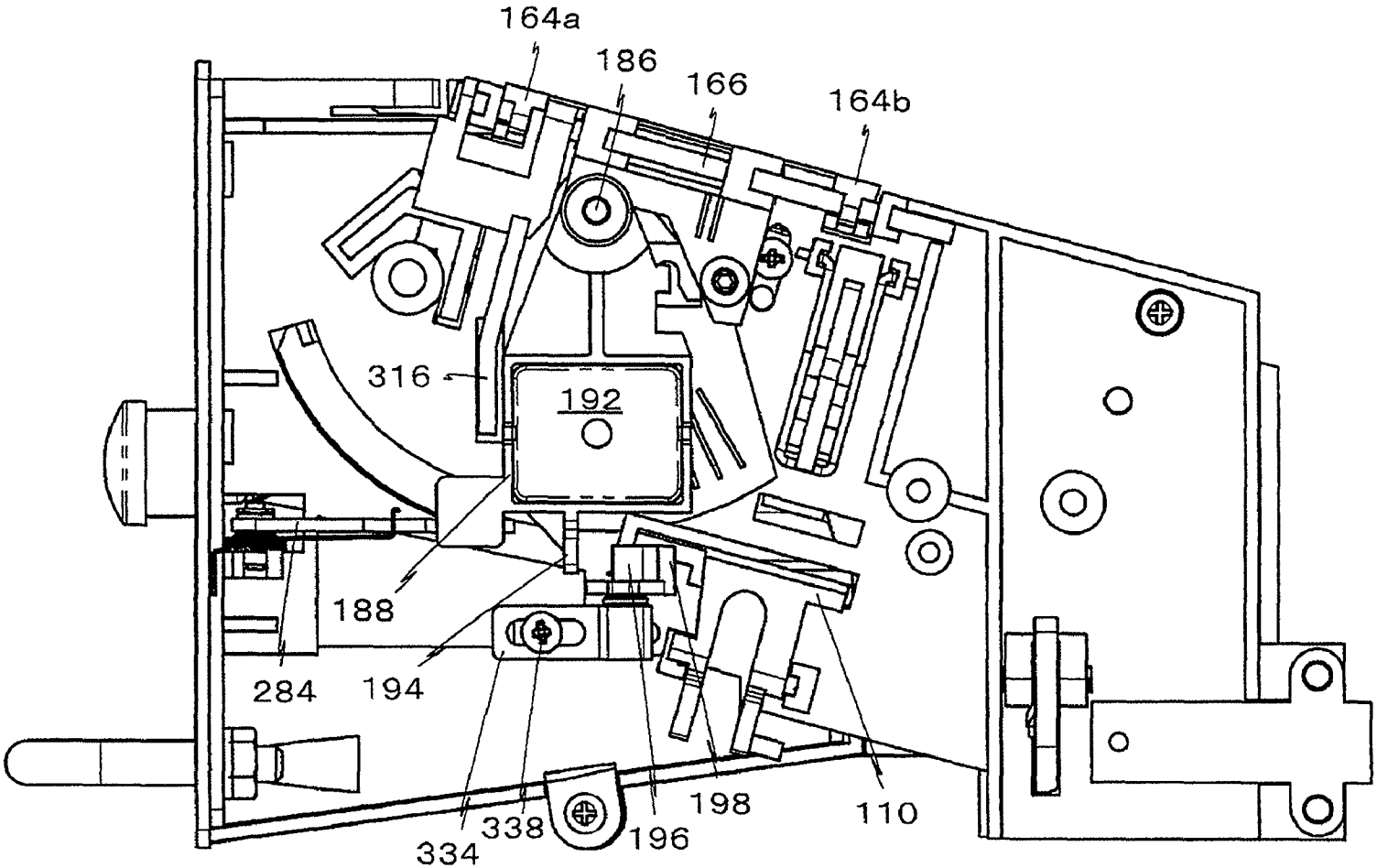
FIG. 28 is a right side view of a coin sorting apparatus having a reeding apparatus according to a fourth embodiment.
Figure 29:
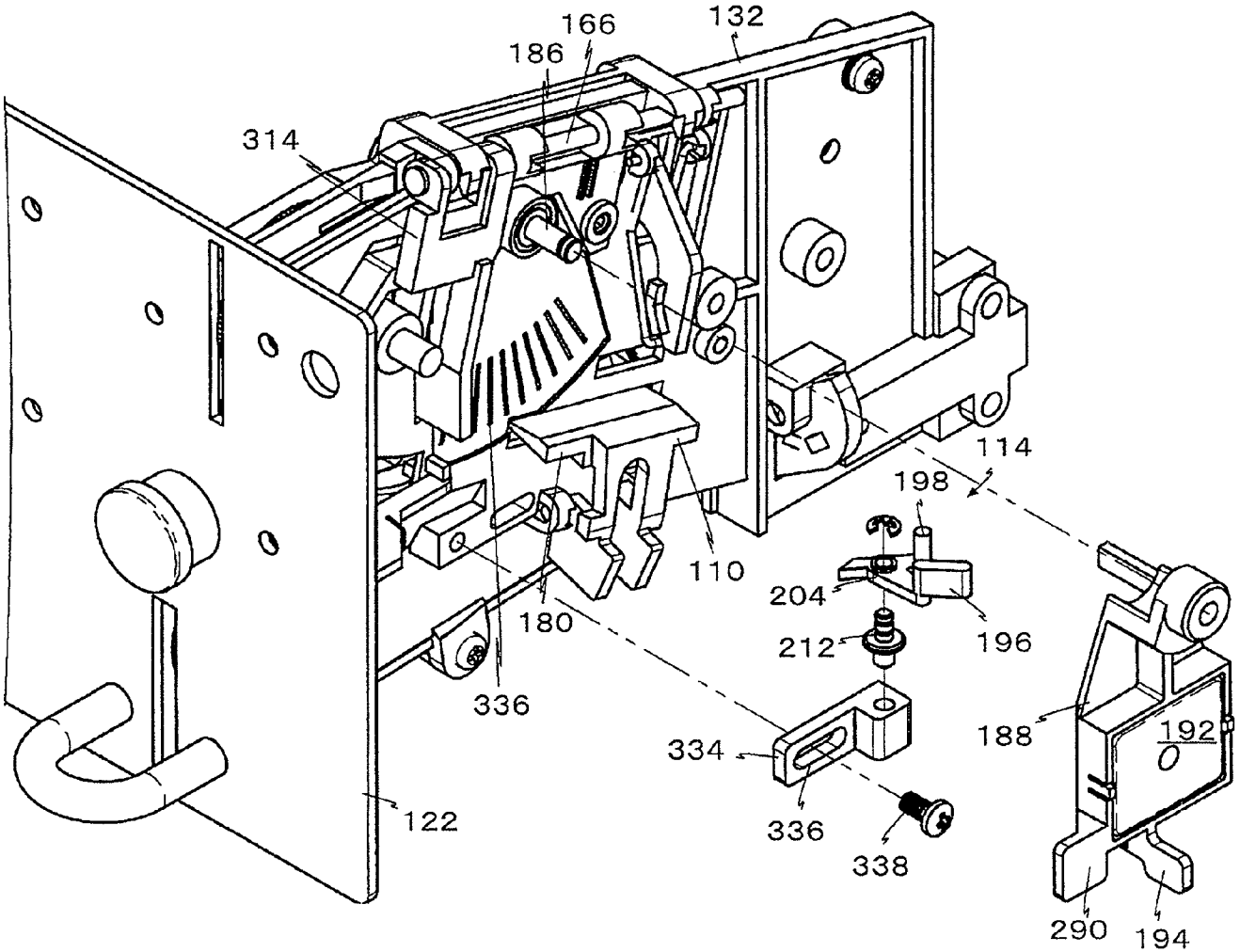
FIG. 29 is a partial exploded perspective view of the coin sorting apparatus having the reeding apparatus according to the fourth embodiment.

A reeding detection apparatus 120 according to a second embodiment is explained below with reference to FIGS. 25 to 27. The reeding detection apparatus 120 according to the second embodiment is an example in which a plurality of detection bodies 256 are provided. In the second embodiment, three thin-plate-shaped detection bodies 256 are provided. The detection bodies 256 may be provided in any number of pieces of two or more. In view of the effect, two or three pieces are preferred. The three detection bodies 256*a*, 256*b*, and 256*c* of the second embodiment are three pieces of detection bodies 256, each of which is identical to the detection body 256 of the first embodiment, stacked and engaged with the receiving portion 264. Ends of the detection bodies 256*a*, 256*b*, and 256*c* are normally disposed at the coin path 106*d*, such that the ends are contactable with the upper side peripheral surface of the coin C. The three detection bodies 256*a*, 256*b*, and 256*c* are all identical, except that the length thereof is provided so as to have a relationship of 256*a*>256*b*>256*c*. Thus, the ends 272*a*, 272*b*, and 272*c* contact with the upper side peripheral surface of the coin C at slightly different positions. The ends 272*a*, 272*b*, and 272*c* may contact (collide) with the peripheral surface (reeding G) of the coin C at the same timing or slightly different timings.

Operations of the reeding detection apparatus 120 of the second embodiment are explained below. When the true coin TC having the reeding G rolls on the moving guide rail 110, one or the plurality of ends 272*a*, 272*b*, and 272*c* of the detection bodies 256*a*, 256*b*, and 256*c* simultaneously hook into the reeding G (FIG. 26), the hooking detection bodies 256*a*, 256*b*, and 256*c* are moved in the extension direction thereof (rolling direction of the coin C). In FIG. 26, the ends 272*b* and 272*c* hook into the reeding G of the coin C, the detection bodies 256*b* and 256*c* are moved slightly to the left in the drawing. The receiving portion 264 is rotated counterclockwise immediately thereafter. Thus, a small gap is provided between the detection bodies 256*a*, 256*b*, and 256*c*. When the detection bodies 256*b* and 256*c* are moved, the axis receiver 262 is rotated counterclockwise in FIG. 25 via the receiving portion 264. The axis receiver 262 is rotated until the sorting body 121 is engaged with the first projection 236, as shown in FIG. 27, and is continuously positioned thereat by the holding apparatus 288. In this case, the detection body 256*a* does not hook into the reeding G, but is moved in the same direction via the receiving portion 264. Thereby, the ends 272*a*, 272*b*, and 272*c* of the detection bodies 256*a*, 256*b*, and 256*c* are removed from the coin path 106*d*, and thus the coin C rolling on the second fixed guide rail 200 drops to the vertical standing path 201 as the true coin TC, similar to the first embodiment. When the detection bodies 256 are provided in a plurality of pieces, a probability in which the ends 272*a*, 272*b*, and 272*c* hook into the groove GC is increased in proportion to the number of ends. In the present second embodiment, the probability is three times the case of a single piece. Further, when the detection bodies 256*a*, 256*b*, and 256*c* are stacked, a weight of the upper detection body is added to the lower detection body. The weight is then substantially increased, thus allowing the detection body to easily hook into the groove GC. An advantage is that a probability of determining the true coin TC is significantly increased, compared with the case of a single detection body 256. When the false coin FC having no reeding G is inserted, the detection bodies 256*a*, 256*b*, and 256*c* are not moved, similar to the first embodiment. Thus, the false coin FC is stopped from rolling by the sorting body 121, and returned to the return slot 126.

Third Embodiment

A coin sorting apparatus 100 having the reeding detection apparatus 120 of the first embodiment is explained below with reference to FIGS. 1 to 24. The inlet 102 is first explained with reference to FIG. 1. In the present third embodiment, two inlets 102 are juxtaposed. Since only either of the inlets may be acceptable, however, only one is shown on the coin sorting apparatus 100. The inlet 102 has an elongated rectangular slit shape, and is inserted with the coin C to be sorted. Further, the inlet 102 is provided slightly greater in width and height than the true coin, and thus the inlet 102 separates the false coin FC having a greater width or diameter than the true coin. The inlet 102 is provided in an upper central portion of a front plate 122, which is provided standing vertically and has a rectangular planar shape. The front plate 122 is formed of a non-magnetic material so as not to impact the sorting performance. The push-type cancel button 124 for cancellation is slidably provided in an intermediate portion in a direction orthogonal to the front plate 122, specifically in a lateral direction. The return slot 126 having a vertically long slit shape is provided to a lower portion of the front plate 122. A U-shaped coin holder 128 is fixed to the front plate 122 at a lower front portion of the return slot 126. The coin holder 128 stops the returned coin C while a rear end of the coin C remains in the return slot 126. In other words, the returned coin C is stopped from rolling by the coin holder 128, and thus the coin C stands still.

The coin sorting apparatus 100 mainly has the front plate 122, the cancel button 124, the main body plate 132, and the cancel door 134.

The main body plate 132 is first explained. The main body plate 132 is mounted with components of the coin sorting apparatus 100. The main body plate 132 demarcates the moving path 106. The main body plate 132 is formed of a non-magnetic material, such as resin, and has an L shape from a plan view. The main body plate 132 has a short side portion 136 and a long side portion 138 having substantially a pentagonal shape from a side view. The short side portion 136 is fixed to a rear surface of the front plate 122. The long side portion 138 is provided substantially standing vertically. A surface opposed to the cancel door 134 forms a first vertical guide surface 140 (refer to FIG. 7).

Figure 6:
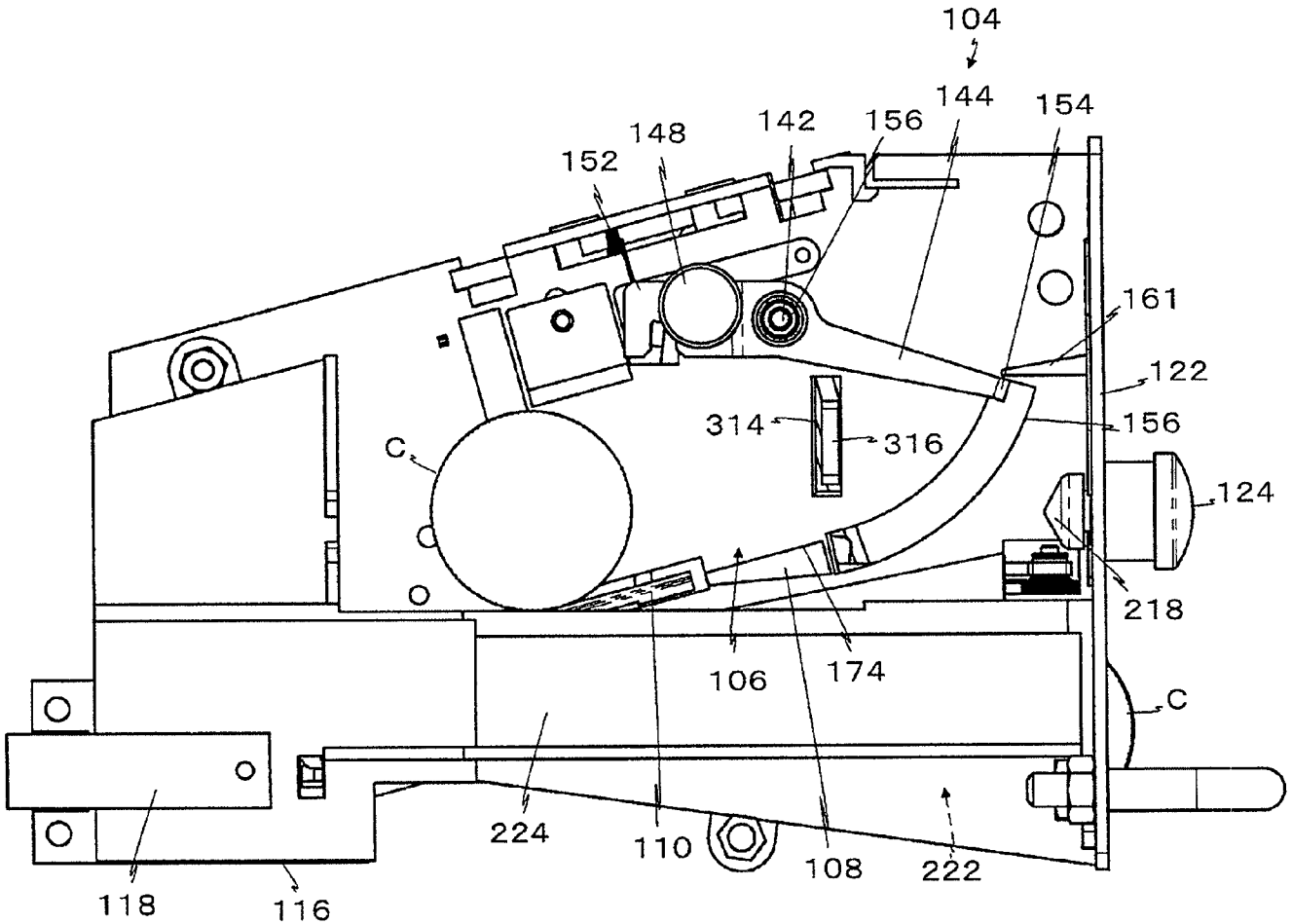
FIG. 6 is a left side view of the coin sorting apparatus in FIG. 5, when a door plate is removed to return a coin to a return slot.
Figure 7:
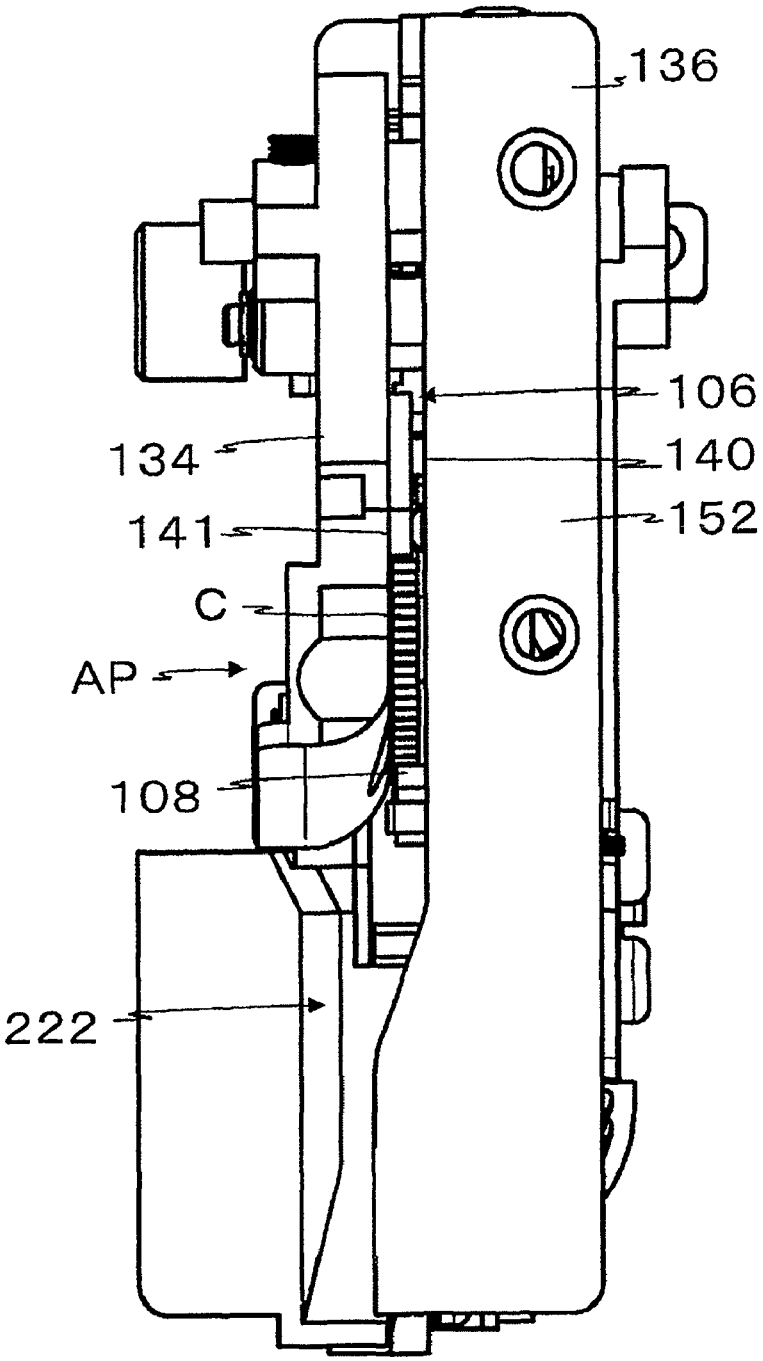
FIG. 7 is a cross-sectional view of the coin sorting apparatus along line X-X in FIG. 4.

The cradle 104 is explained below mainly with reference to FIG. 6. The cradle 104 sorts out the coins C into the true coins TC and the false coins FC based on the diameter and weight. The cradle 104 of the present third embodiment has a fixed axis 142, a cradle body 144, a diameter regulating body 146 (refer to FIGS. 9A to 9C), and a weight 148.

Figure 9A:
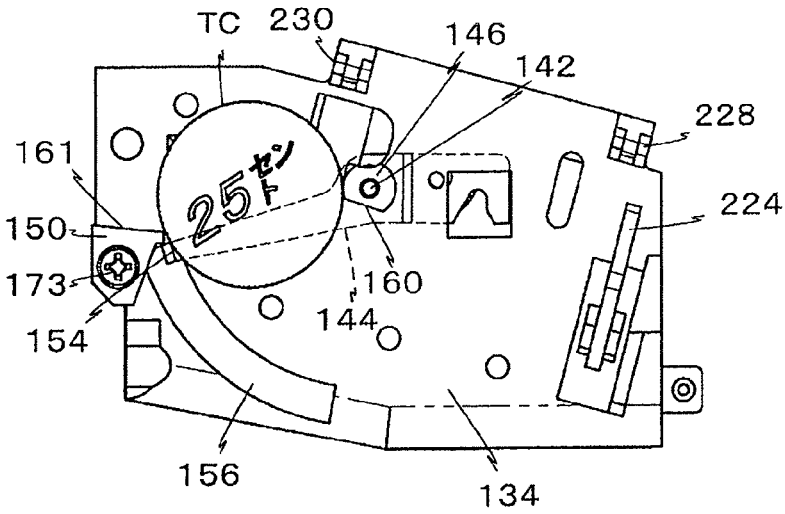
FIGS. 9A to 9C illustrate operations of a cradle of the coin sorting apparatus according to the third embodiment of the present invention.
Figure 9B:
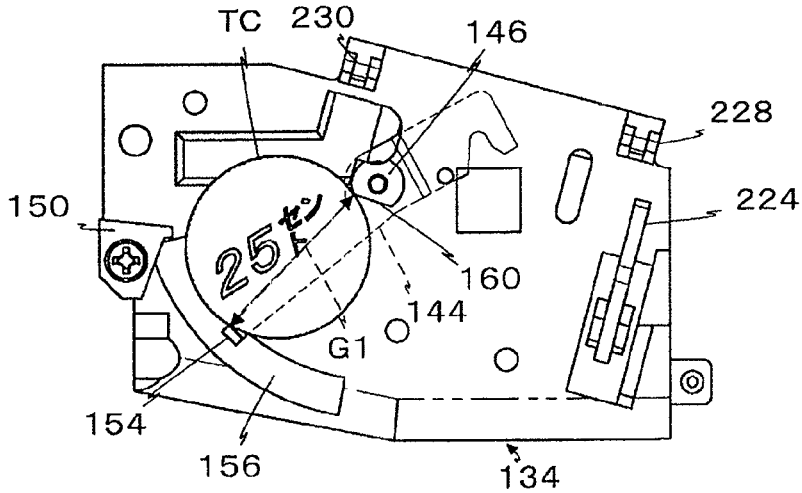
Figure 9C:
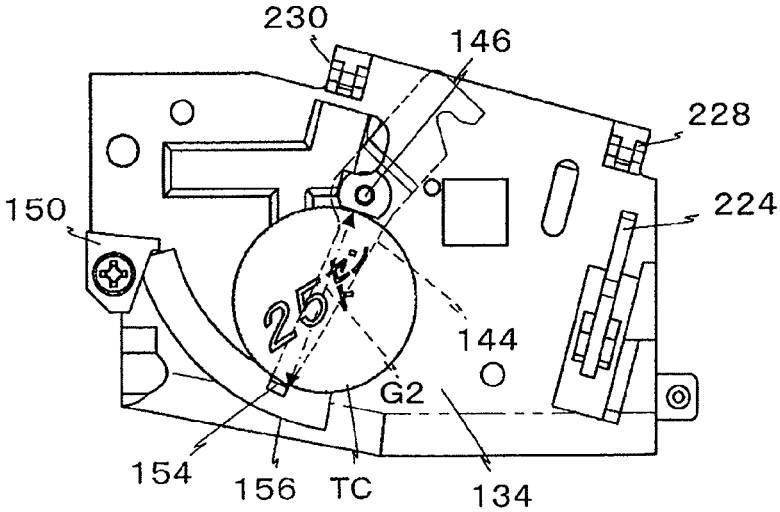

The fixed axis 142 is provided projecting laterally to a rear surface of the cancel door 134 provided proximate to the inlet 102. The cradle body 144 has a support piece 154 formed by bending an end portion of a lever 152 orthogonally to the main body plate 132 side. The cradle body 144 is rotatably supported to the fixed axis 142 through a bush 156 in an intermediate portion. An end portion of the support piece 154 penetrates arcuate openings 156 and 157 provided to the cancel door 134 and the main body plate 132. As shown in FIGS. 9A to 9C, the cylindrical diameter regulating body 146 contacts with a second vertical guide surface 141, is tightly mounted externally to the fixed axis 142, and forms a gap G1 between a peripheral surface thereof and the support piece 154, the gap G1 being a slightly smaller than the diameter of the true coin TC. Specifically, the gap G1 is provided slightly smaller than the diameter of the 25 cent coin of 26 mm. A lower surface of the diameter regulating body 146 is chamfered, and thereby a flat surface 160 is provided. A gap G2 between the support piece 154 and the flat surface 160 is provided slightly greater than the diameter of the true coin TC. Thus, when the support piece 154 is rotated to a position opposite to the flat surface 160, as shown in FIG. 9C, the true coin TC can roll and drop from the support piece 154 to the left by self weight.

The weight 148 is fixed to a side surface of the cradle body 144 provided on an opposite side to the support piece 154, having the fixed axis 142 in between. When the coin C is not supported by the support piece 154 and the diameter regulating body 146, the weight 148 provides the cradle body 144 with a clockwise rotation force in FIGS. 9A to 9C. The cradle body 144 is prevented from being rotated by a cradle sorting body 150 fixed to the second vertical guide surface 141, and held at a cradle standby position CSP. When the coin C having a predetermined weight is placed between the support piece 154 and the diameter regulating body 146, a counterclockwise moment in FIGS. 9A to 9C is exerted, and then the cradle body 144 is rotated counterclockwise. In other words, when the 25 cent true coin TC is placed between the diameter regulating body 146 and the support piece 154, the cradle body 144 is rotated clockwise in FIG. 6. The false coin FC having a smaller diameter than the true coin TC is not supported, however, between the support piece 154 and the diameter regulating body 146, and drops downward through therebetween. Further, the false coin FC lighter than the true coin TC is unable to rotate the cradle body 144, and thereby the true coin TC and the false coin FC are sorted out. An upper surface of the cradle sorting body 150 is provided to an insertion guide rail 161, which is a front downward inclined surface connecting from the inlet 102 to the support piece 154. The coin C inserted to the inlet 102 thus rolls on the insertion guide rail 161 and is guided to the cradle 104.

The moving path 106 of the coin C is explained below mainly with reference to FIGS. 6 and 10. The moving path 106 guides the coin C. The moving path 106 is provided with the main body plate 132 and the cancel door 134, and is a planar space provided substantially standing vertically subsequent to the inlet 102. The first vertical guide surface 140, which is a side surface of the main body plate 132, is provided to a first vertical side edge of the inlet 102. The second vertical guide surface 141, which is a side surface of the cancel door 134, is provided continuously to a second vertical side edge of the inlet 102. Thus, the coin C inserted to the inlet 102 normally moves on the moving path 106 while being guided on a side surface by the first vertical guide surface 140 and the second vertical guide surface 141.

The cancel door 134 is explained below mainly with reference to FIGS. 1, 3, and 9A to 9C. The cancel door 134 demarcates one side surface of the moving path 106, and drops a jammed coin C on the moving path 106, such as the cradle 104, to the cancel path 222. The cancel door 134 is integrally formed of a non-magnetic body, such as resin, and has a pentagonal shape from a side view. An axis receiver 162 in an upper end portion of the cancel door 134 is rotatably supported by an axis 166, which is supported by axis receivers 164*a* and 164*b* provided to an upper end portion of the main body plate 132 on an opposite side to the moving path 106. The cancel door 134 is provided with a predetermined rotation force toward the main body plate 132 by a wire-shaped spring 169. The wire-shaped spring 169 is integrally provided with the cancel door 134, projecting laterally downward from the upper end portion; penetrates an opening 170 of the main body plate 132; and has a lower end portion urging an arm 168 extending on a rear surface of the main body plate 132. A pin 172 (refer to FIG. 8) is pressed against the main body plate 132, the pin 172 laterally projecting from the main body plate 132 toward the cancel door 134. Thereby, the cancel door 134 allows the second vertical guide surface 141 to be provided opposite to the first vertical guide surface 140, having a gap slightly greater than the true coin C. The surface of the cancel door 134 opposed to the first vertical guide surface 140 is the second vertical guide surface 141. The first vertical guide surface 140 and the second vertical guide surface 141 are elastically held in parallel by the spring 169. Thus, the cradle 104 is provided to the moving path 106 subsequent to downstream of the inlet 102.

The insertion guide rail 161 projects laterally from the main body plate 132 by a screw 173. The insertion guide rail 161 has a front downward inclined upper surface, and guides the coin C inserted to the inlet 102 to the cradle 104. In other words, the coin C inserted to the inlet 102 rolls on the insertion guide rail 161, and then reaches the cradle 104.

The fixed guide rail 108 is explained below mainly with reference to FIG. 6. The fixed guide rail 108 rolls the coin C moved by the cradle 104 and guides the coin C to a predetermined direction. The fixed guide rail 108 projects laterally from the main body plate 132 below the fixed axis 142 of the cancel door 134. In a portion farther from the inlet 102, the fixed guide rail 108 is provided with a front downward fixed rolling surface 174 positioned below. Specifically, the fixed guide rail 108 demarcates a portion of a lower surface of the moving path 106. In other words, the coin C moved by the cradle 104 and determined as the true coin TC in view of the diameter and weight rolls by self weight on the fixed rolling surface 174 in a direction away from the inlet 102.

Figure 2:
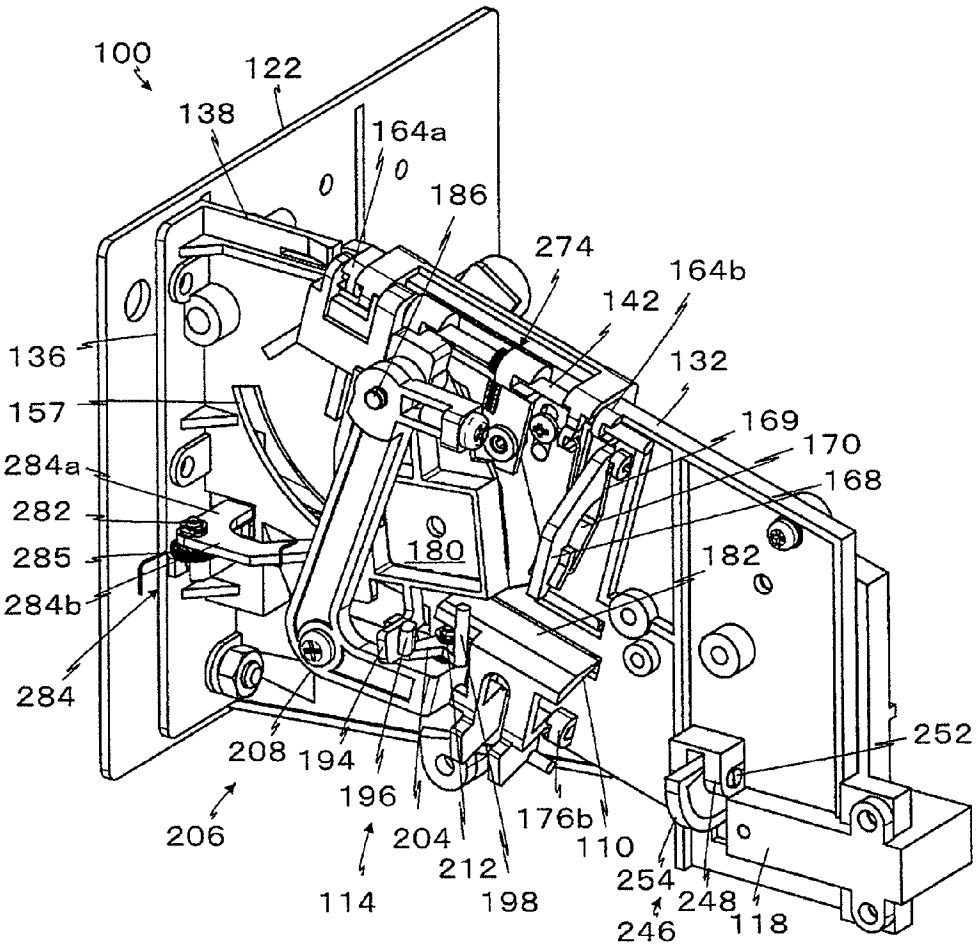
FIG. 2 is a perspective view from upper rear right of the coin sorting apparatus according to the third embodiment of the present invention.
Figure 4:
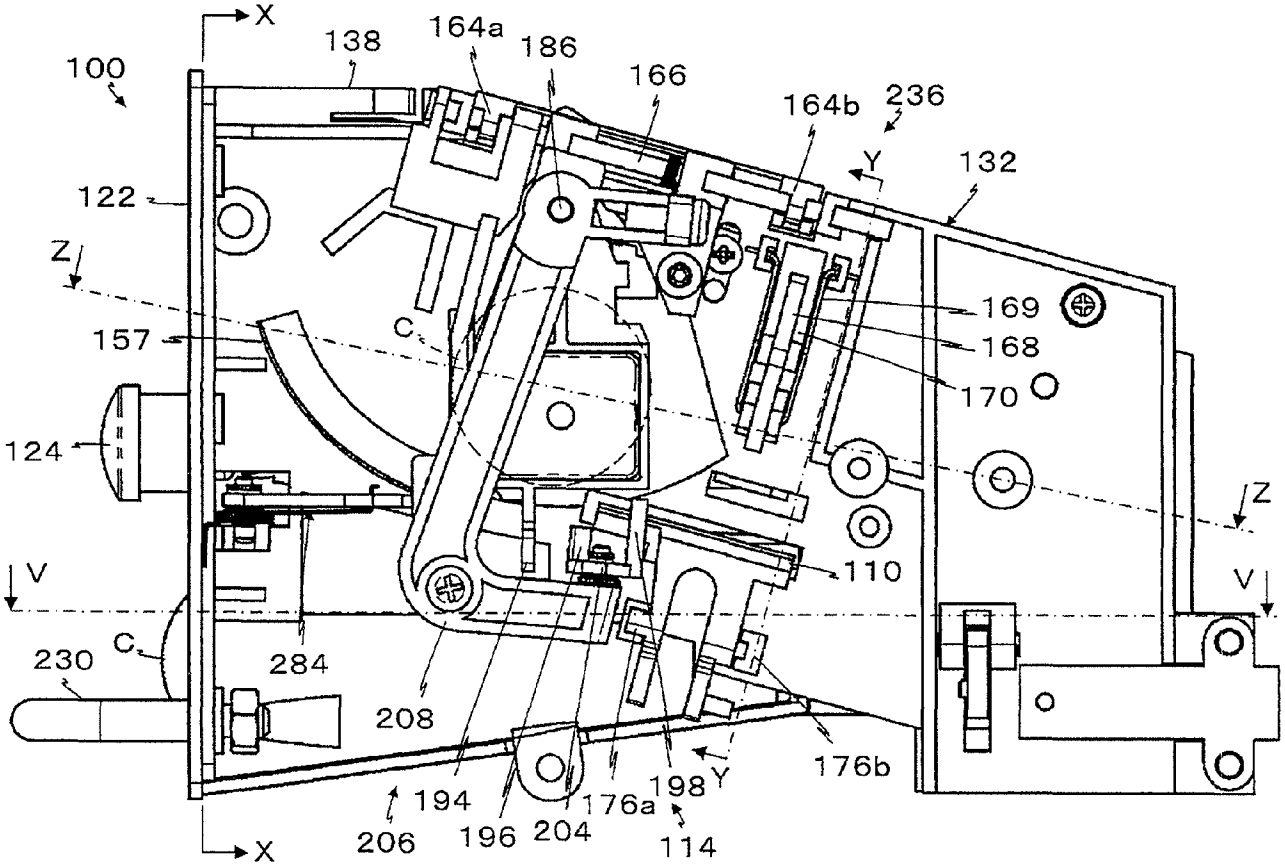
FIG. 4 is a right side view of the coin sorting apparatus according to the third embodiment of the present invention.

The moving guide rail 110 is explained below mainly with reference to FIGS. 2 and 4. The moving guide rail 110, which is provided immediately downstream of the fixed guide rail 108, guides the true coin TC rolling on the fixed guide rail 108 to a predetermined direction, and drops the false coin FC from a downstream end of the fixed guide rail 108. In other words, the moving guide rail 110 is normally positioned at the standby position SP (refer to FIG. 12) external to the moving path 106. When the true coin TC rolls on the fixed guide rail 108, the moving guide rail 110 is positioned at a guide position GP (refer to FIG. 13) indirectly by the true coin TC, the guide position GP being provided on an a downstream side extension of the fixed guide rail 108. Thus, the true coin TC can roll.

Figure 12:
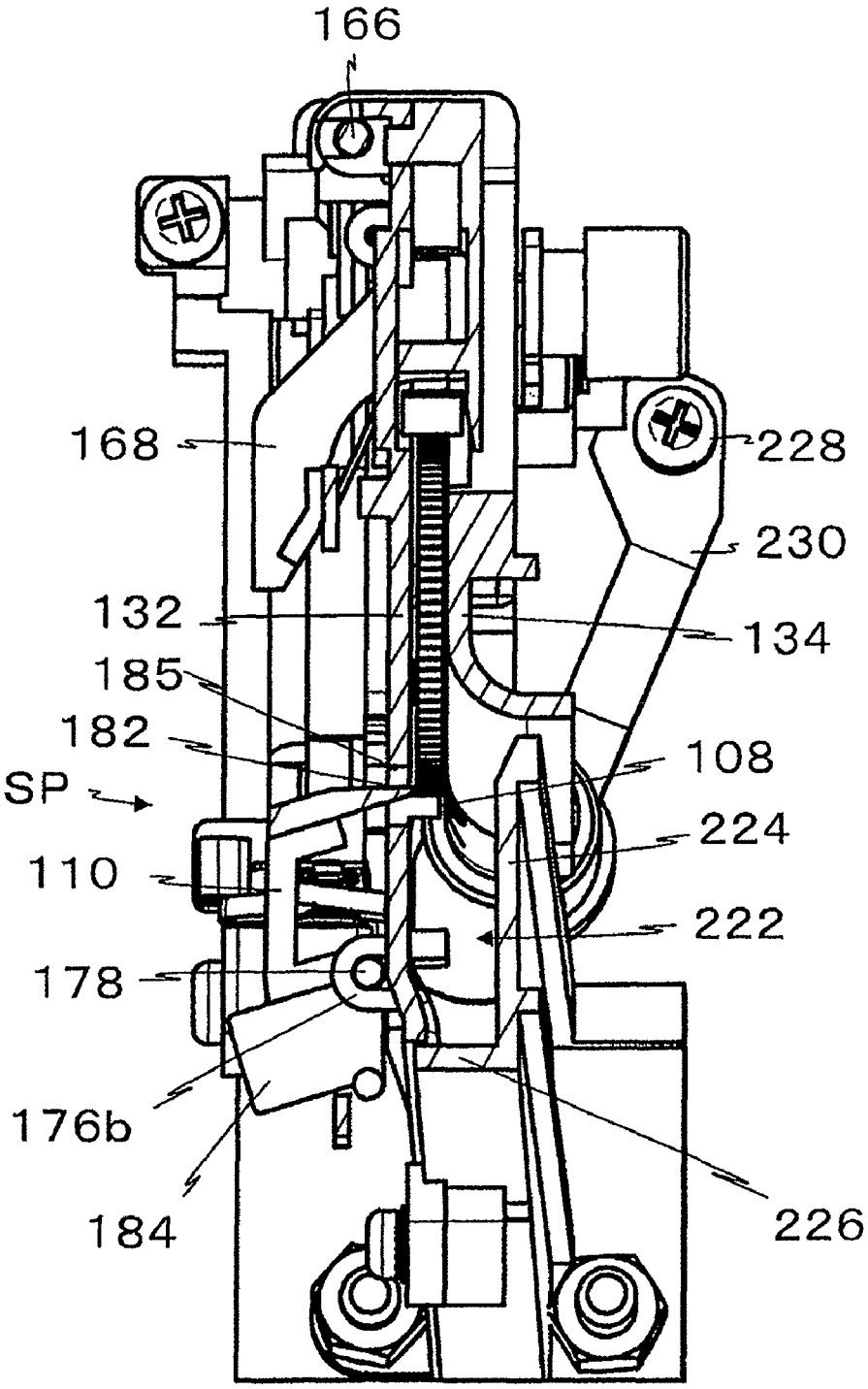
FIG. 12 is a cross-sectional view of the coin sorting apparatus along line Y-Y in FIG. 4 (standby mode)
Figure 13:
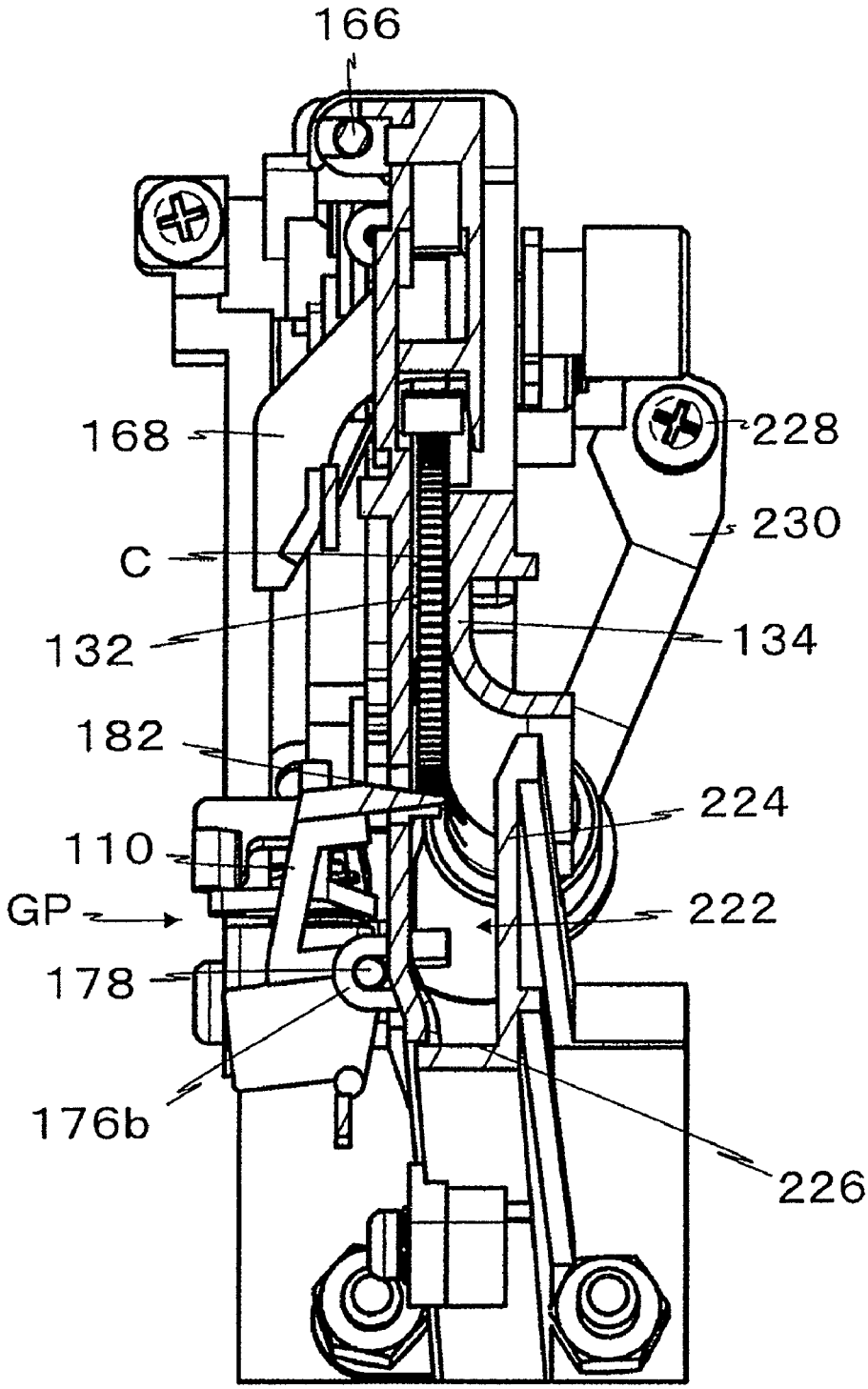
FIG. 13 is a cross-sectional view of the coin sorting apparatus along line Y-Y in FIG. 4 (when a true coin passes)

Axis portions 178 of the moving guide rail 110 are rotatably supported by a pair of axis receivers 176*a* and 176*b*, the axis portions 178 projecting from a lower end portion of the moving guide rail 110 to left and right sides in parallel with the main body plate 132, the axis receivers 176*a* and 176*b* being provided to the main body plate 132 on the opposite side of the moving path 106. The moving guide rail 110 has a lateral channel-shaped cross section. On an upper end portion on an upper side, a moving and rolling surface 182 is provided on which the true coin TC rolls. The moving guide rail 110 is provided such that a counterclockwise moment in FIG. 12 is normally generated by a self moment. The moving and rolling surface 182 is held by the moment to the standby position SP external to the moving path 106. In other words, a lower end portion 184 of the moving guide rail 110 is engaged by the rear surface of the main body plate 132; and the moving and rolling surface 182 is held to the standby position SP positioned at an opening 185 provided to the main body plate 132. When the true coin TC rolls on the fixed guide rail 108, however, the moving guide rail 110 is moved to the moving path 106 via the magnet body 112 and the interlocking mechanism 114. The moving and rolling surface 182 then demarcates the lower surface of the moving path 106. Thus, the true coin TC rolls, as being guided on the moving and rolling surface 182 subsequent to the fixed rolling surface 174.

When the moving and rolling surface 182 is positioned at the guide position GP proceeding to the moving path 106, the moving and rolling surface 182 is provided to a down facing surface, which is positioned lower as being away from the main body plate 132. A portion of the moving guide rail 110 is cut out on the inlet 102 side on the opposite side to the moving path 106, and thereby a moved edge 180 is provided. The moved edge 180 is provided extending for a predetermined length toward the inlet 102 substantially in parallel with the main body plate 132, on the opposite side to the moving path 106 of the main body plate 132. Thereby, the moved edge 180 can be pressed by the interlocking mechanism 114, even when the position of the interlocking mechanism 114 is changed.

Figures 15A, 15B:
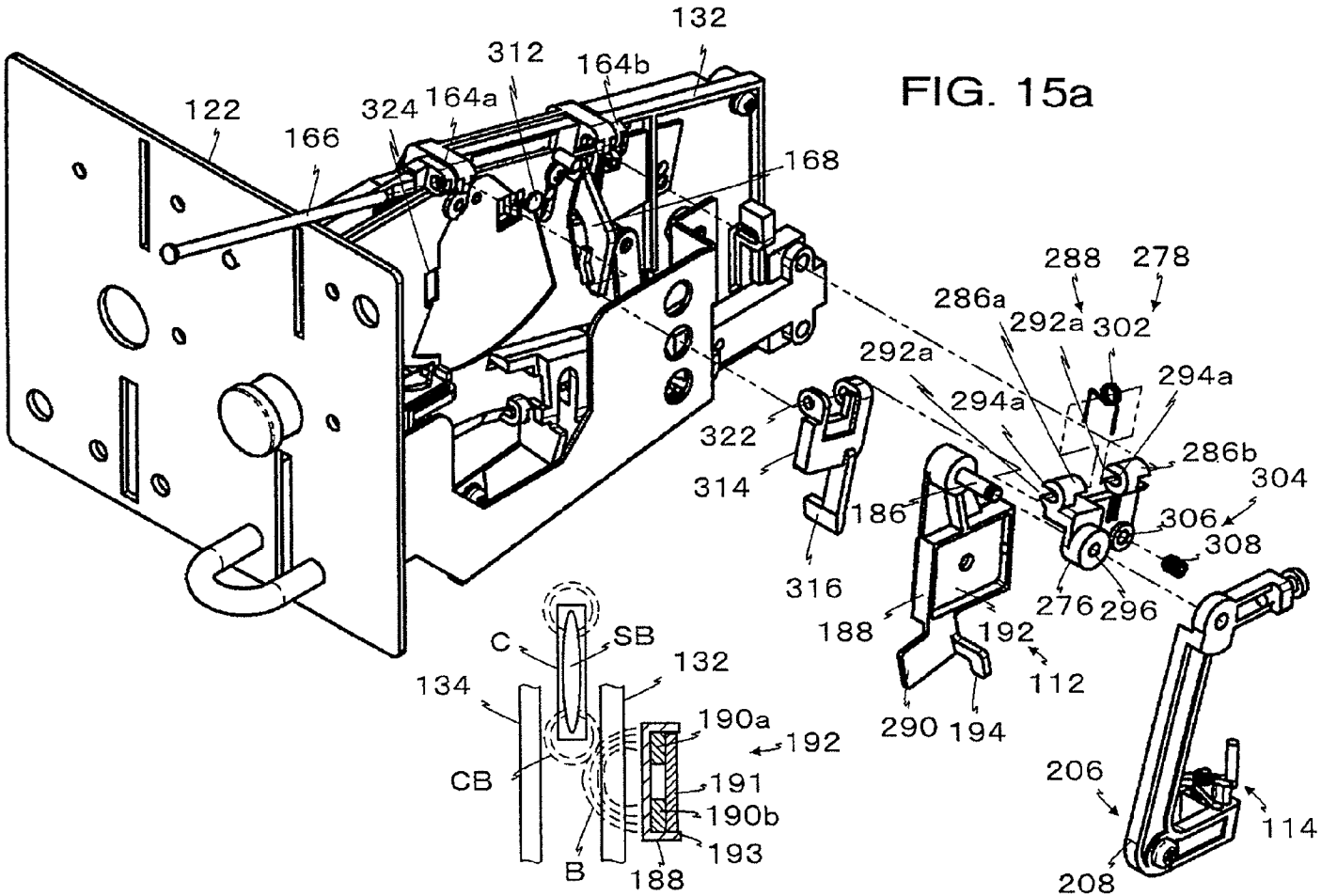
FIG. 15A is an exploded perspective view of a magnetic body and the like of the coin sorting apparatus according to the third embodiment of the present invention.
FIG. 15B illustrates operations of the magnetic body.

The magnetic body 112 is explained below mainly with reference to FIGS. 4, 15A, and 15B. When the true coin TC rolls on the fixed guide rail 108, the magnetic body 112 is moved in the same direction as the true coin TC, and thereby the magnetic body 112 moves the moving guide rail 110 to the guide position GP via the interlocking mechanism 114. The magnetic body 112 has a swing lever 188 and a permanent magnetic body 192, the swing lever 188 having an upper end portion swingably supported by a second fixed axis 186 projecting laterally on the rear surface side of the main body plate 132, the permanent magnetic body 192 being fixed to a lower end portion of the swing lever 188. As shown in FIG. 15B, the permanent magnetic body 192 is provided with a pair of permanent magnets 190*a* and 190*b* attached to one magnetic plate 191. The permanent magnetic body 192 is inserted to a lateral holding hole 193 provided in an intermediate portion of the swing lever 188, and is fixed to the holding hole 193 with an adhesive and the like. Thus, the swing lever 188 normally stands still at a drooping position by gravity. When the swing lever 188 droops, the permanent magnetic body 192 is provided opposite to the moving path 106 above the fixed guide rail 108. With the structure, a magnetic field B of the permanent magnets 190*a* and 190*b* integrated by the magnetic plate 191 affects inside of the moving path 106.

The permanent magnetic body 192 is provided opposite to the moving path 106 above the fixed guide rail 108, having the main body plate 132 in between. When the true coin TC rolls on the fixed guide rail 108, the magnetic field B of the permanent magnet body 192 affects a strong conductive body SB of the true coin TC. The magnetic field B generates an internal electromotive force in the strong conductive body SB, and an eddy current flows, which generates a magnetic field CB around the true coin TC. The magnetic field CB, which is generated by the permanent magnetic body 192, has a magnetism in an opposite direction to that of the permanent magnetic body 192. In other words, the true coin TC has the magnetism opposite to the magnetism of the magnetic body 112, and thus the magnetic body 112 receives a pressing force from the true coin TC. Thereby, the magnetic body 192 is moved in the same direction as the rolling true coin TC. In other words, the swing lever 188 is rotated for a predetermined amount in the same direction, in accordance with the movement of the true coin TC. When the self moment exerted on the swing lever 188 exceeds the pressing force by the true coin TC, the swing lever 188 swings in an opposite direction in order to maintain the drooping position, and then eventually stands still at the drooping position.

The interlocking mechanism 114 is explained below mainly with reference to FIGS. 2 and 4. The interlocking mechanism 114 moves the moving guide rail 110 to the guide position GP according to a predetermined amount of movement of the magnetic body 112. In the present third embodiment, the interlocking mechanism 114 has a pressing piece 194, an interlocking moved piece 196, and an interlocking pressing piece 198. The pressing piece 194 is first explained. The pressing piece 194 is provided projecting downward from a lower end of the swing lever 188. The pressing piece 194 presses the interlocking moved piece 196. The roll of the true coin TC on the fixed guide rail 108 rotates the magnetic body 112, hence the swing lever 188, counterclockwise in FIG. 4 for a predetermined amount. The pressing piece 194 then presses the interlocking moved pieced 196 for a predetermined amount. Thus, the interlocking pressing piece 198 presses the moved edge 180 for a predetermined amount, and then the moving guide rail 108 is moved to the guide position GP. After the true coin TC passes, the swing lever 188 stands still at the drooping position by the moment due to gravity, and prepares for insertion of the next coin C. Thus, the moving guide rail 110 returns to the standby position SP by the self moment. When the false coin FC, which is a weak/medium conductive body, rolls on the fixed guide rail 108, the electromotive force generated in the false coin FC is small, and the generated magnetic force is small. Thus, the swing lever 188 is not rotated for the predetermined amount, and the moving guide rail 110 is not moved to the guide position GP. Thereby, the false coin FC drops from the downstream end of the fixed guide rail 108 to the cancel path, and then is separated.

The interlocking moved piece 196 and the interlocking pressing piece 198 are explained below. The interlocking moved piece 196 and the interlocking pressing piece 198 are provided projecting upward from a crank-shaped interlocking body 204 rotatably supported by a support axis 202. When the swing lever 188 is rotated more than the predetermined amount by the true coin TC, the interlocking moved piece 196 is moved by the pressing piece 194, and the interlocking body 204 is rotated. Thus, the interlocking pressing piece 198 approaches the moved edge 180. Accordingly, when the interlocking pressing piece 198 is rotated more than the predetermined amount, the moved edge 180 is pressed, and thus the moving guide rail 110 is moved to the guide position GP. When the interlocking pressing piece 198 is retracted, the moving guide rail 110 returns to the standby position SP by the self moment. In the present third embodiment, the interlocking mechanism 114 is corrected its position by an inclination correction mechanism 206.

The inclination correction mechanism 206 is explained below mainly with reference to FIGS. 15A and 15B. Even when the coin sorting apparatus 100 is tilted, the inclination correction mechanism 206 moves the moving guide rail 110 to the guide position GP only by the movement of the magnetic body 112 for more than a predetermined amount. In other words, the inclination correction mechanism 206 prevents fraud in which when the coin sorting apparatus 100 is intentionally tilted in a direction to which the inclination of the moving path 106 is great, the false coin FC having a low/medium conductivity rotates the magnetic body 112, and thus is wrongly sorted as the true coin TC. The inclination correction mechanism 206 in the present third embodiment is mounted to a second swing lever 208, which is rotatably supported by the second fixed axis 186 on the same axis as the swing lever 188. The second swing lever 208 has a lateral channel shape. An upper corner portion of the second swing lever 208 is swingably supported by the second fixed axis 186. A support axis 212 is fixed upward to an end of a lower end horizontal portion of the second swing lever 208. The interlocking body 204 is supported by the support axis 212.

With the structure above, the second swing lever 208 droops by the self moment due to gravity, and the interlocking mechanism 114 is held such that the interlocking pressing piece 198 and the moved edge 180 are held in a predetermined positional relationship. In other words, when the main body plate 132 is tilted within a flat surface on which the main body plate 132 exits, the second swing lever 208 rotates by the self moment, and the pressing piece 194 attempts to approach the interlocking moved piece 196 while maintaining the drooping status. However, the second swing lever 208 also rotates in the same direction by the self moment, and a positional relationship remains the same of the interlocking pressing piece 198 and the interlocking moved piece 196. Further, a relative position of the interlocking pressing piece 198 to the moved edge 180 changes, but the positional relationship does not substantially change since the moved edge 180 is provided long. In other words, even when the coin sorting apparatus 100 is intentionally tilted, the moving guide rail 110 is not moved to the guide position GP unless the magnetic body 112 is moved for a predetermined amount by the true coin TC.

The true coin slot 116 is explained below mainly with reference to FIG. 5. The true coin slot 116 is a path which the true coin TC reaches after rolling on the second fixed guide rail 200 subsequent to the moving guide rail 110. The true coin TC that has passed the true coin slot 116 is stored in a safe provided below (not shown in the drawing). The second fixed guide rail 200 projects sideways from the main body plate 132. An upper surface of the second fixed guide rail 200 has a forward downward inclined shape positioned lower as being away from the inlet 102. The true coin slot 116 is a lower end of the downward extending vertical standing path 201 provided adjacent to the second fixed guide rail 200 and surrounded on four sides. An end portion of the second fixed guide rail 200 on the moving guide rail 110 side is provided with a triangle climbing projection 210 projecting upward (refer to FIG. 20). Thereby, the coin C rolling on the moving guide rail 110 climbs over the climbing projection 210 and rolls on the second fixed guide rail 200. The climbing projection 210 is provided in a position, such that an upward inclined surface thereof (front upward inclined surface 211) contacts with the coin C when the coin C is prevented from rolling by the sorting body 121. In other words, the climbing projection 210 is provided, such that the front upward inclined surface 211 rolls the coin C in an opposite direction toward the moving guide rail 110. Thereby, the coin C prevented from rolling by the sorting body 121 is dropped to the cancel path 222 from a projecting space of the moving guide rail 110.

The true coin sensor 118 is explained below mainly with reference to FIG. 5. The true coin sensor 118 detects the true coin TC proceeding to the true coin slot 116. A variety of sensors, including mechanical, photoelectric, and magnetic sensors, may be employed as the sensor. A detection signal from the true coin sensor 118 indicates that a single true coin TC is received.

Figure 3:
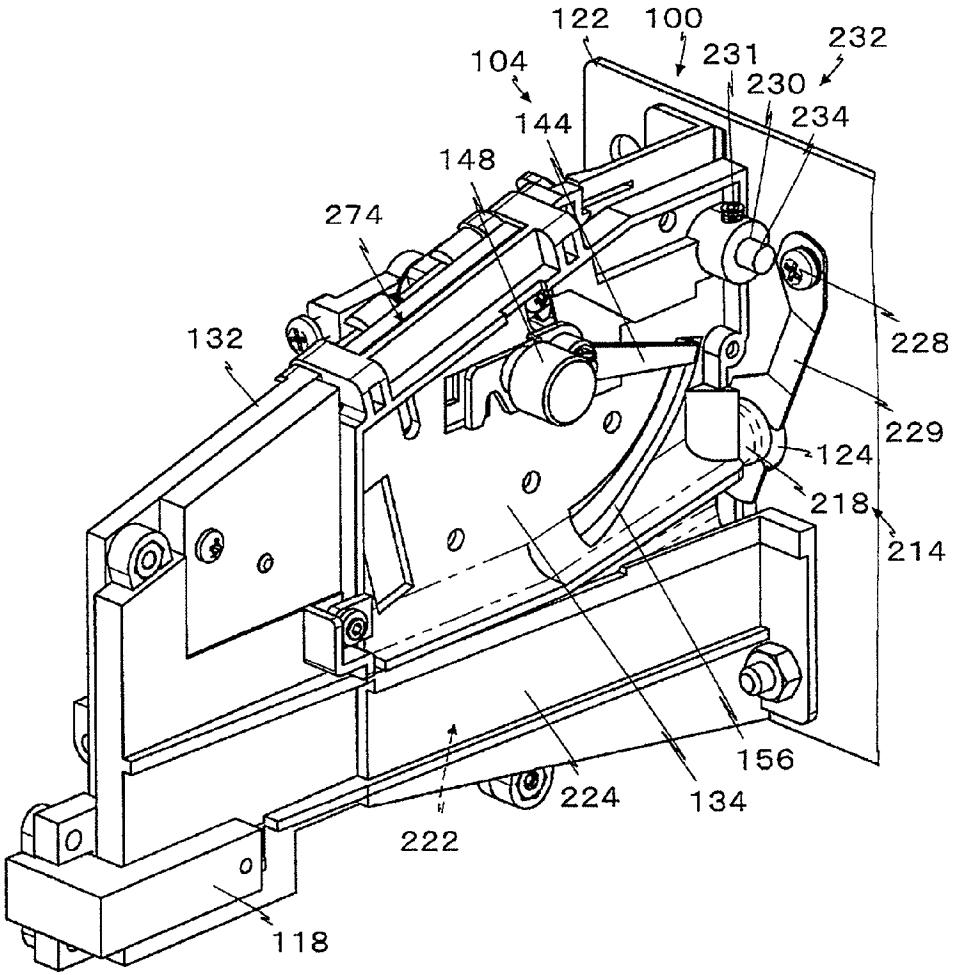
FIG. 3 is a perspective view from upper rear left of the coin sorting apparatus according to the third embodiment of the present invention.
Figure 8:
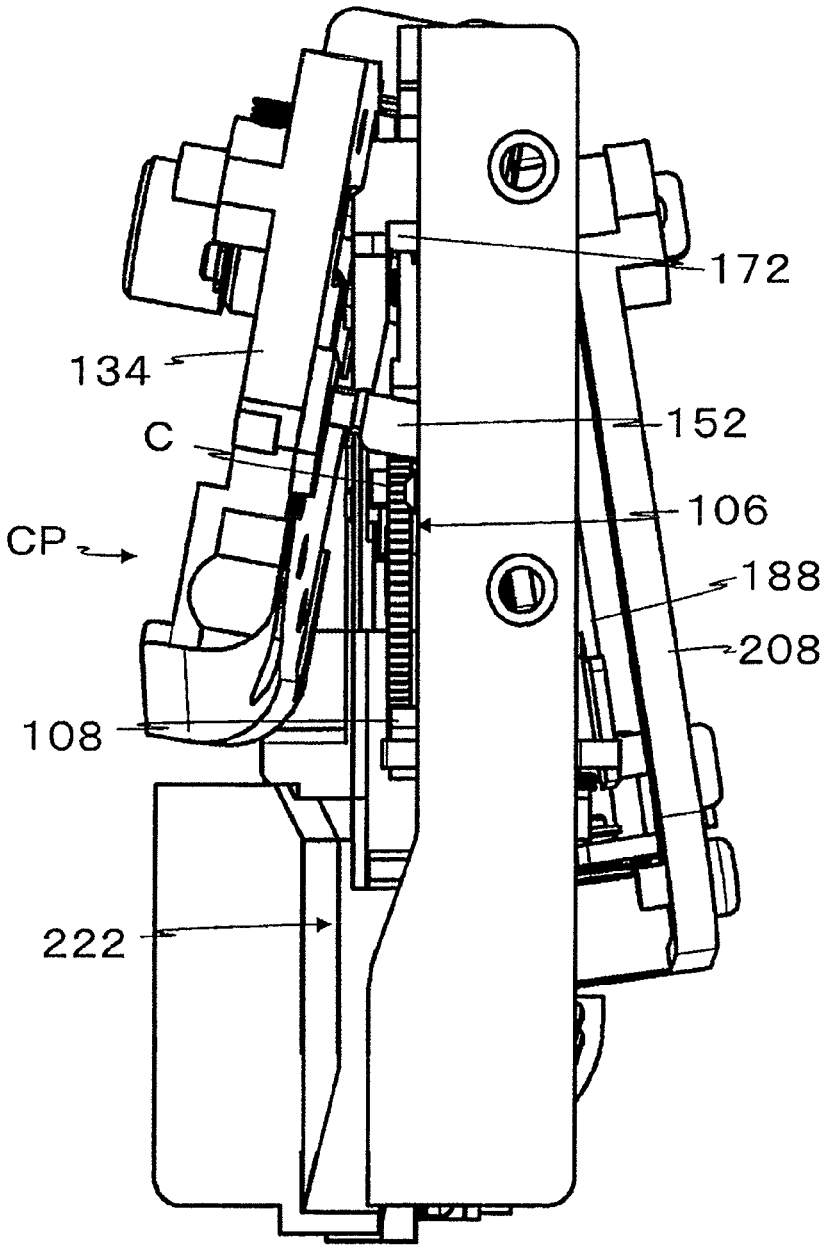
FIG. 8 is a cross-sectional view of the coin sorting apparatus similar to FIG. 7, when the door plate is moved to a cancel position.
Figure 14A:
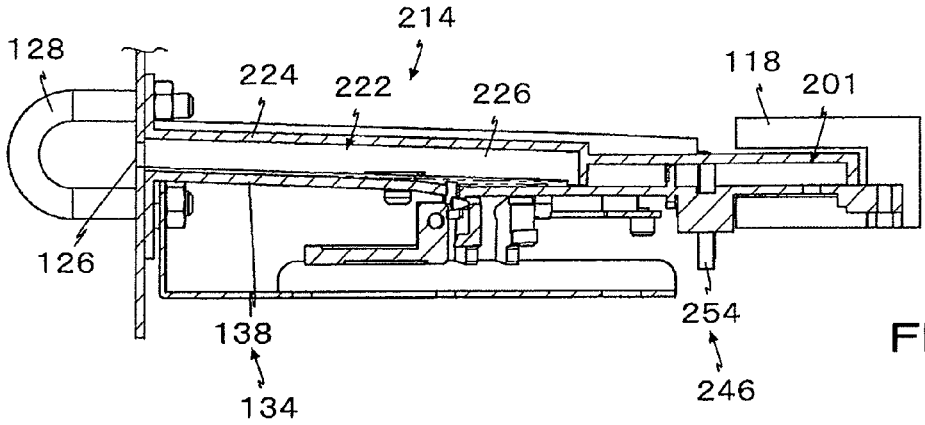
FIG. 14A is a cross-sectional view of the coin sorting apparatus along line V-V in FIG. 4.
Figure 14B:
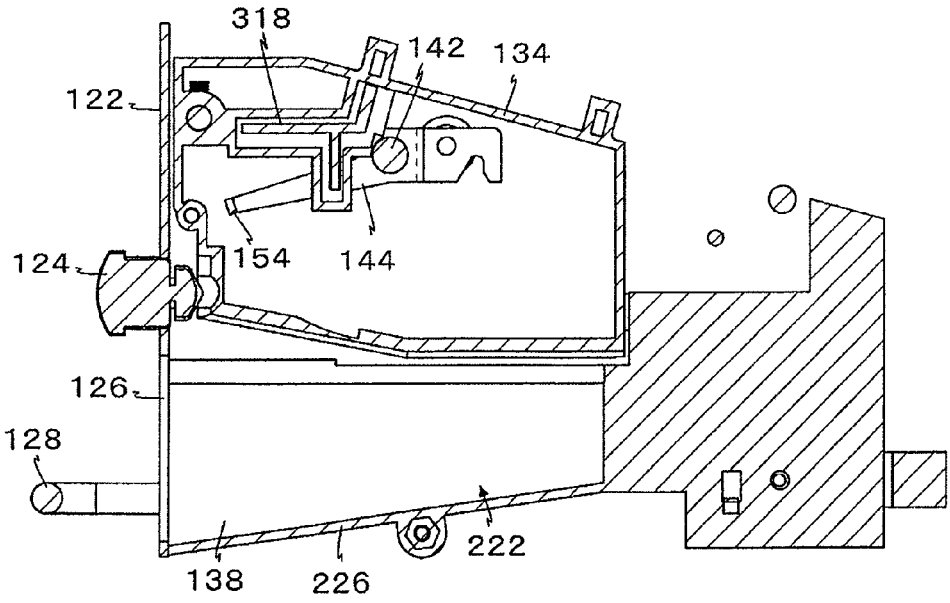
FIG. 14B is a vertical cross-sectional view of the coin sorting apparatus in FIG. 4.

A cancel unit 214 is explained below mainly with reference to FIGS. 3, 14A, and 14B. The cancel unit 214 returns the coin C to the return slot 126 when the coin C is retained on the moving path 106 due to such as a jam. The cancel unit 214 has the cancel button 124, an inclined portion 216, and the cancel path 222. As shown in FIG. 10, the inclined portion 216 is provided to the cancel door 134 on the front plate 122 side. The closer the inclined portion 216 is to the front plate 122, the more inclined the inclined portion 216 is in a direction away from the main body plate 132. A pressing portion 218, which is an end portion of the cancel button 124, has a hemisphere shape. When the cancel button 124 is pressed in, the pressing portion 218 presses the inclined portion 216, and thus the cancel door 134 is pressed away from the main body plate 132. Thereby, as shown in FIG. 8, the cancel door 134 is pivoted around the axis 166; the lower end portion thereof is disengaged from the main body plate 132; and the moving path 106 is expanded in a trapezoidal shape. Thus, the second guide surface 141 is separated from end surfaces of the fixed guide rail 108 and the second fixed guide rail 200 for more than the thickness of the coin C. The coin C retained on the moving path 106 can drop to the cancel path 222 below due to gravity. A second end portion of a plate spring 229 is engaged with an intermediate portion of the cancel button 214, the plate spring 229 having a first end portion fixed to a rear surface of the front plate 122 with a screw 228. The plate spring 229 urges the cancel button 124 forward from the front plate 102 in a projecting direction.

The cancel path 222 is explained below mainly with reference to FIGS. 14A and 14B. The cancel path 222 returns the canceled coin C to the return slot 126. The cancel path 222 has a channel-shaped cross section, formed by the long side portion 138 of the main body plate 132, a cancel guide plate 224, and a cancel guide rail 226. The cancel path 222 extends from the return slot 126 to below the moving guide rail 110. The cancel guide rail 226 is provided front downward toward the return slot 126. Thus, the coin C is dropped to the cancel path 222, the coin C being dropped from the fixed guide rail 108 without being guided by the moving guide rail 110, or being canceled as the cancel door 134 is moved to the cancel position CP. The coin C then rolls on the cancel guide rail 226 as the side surface is guided by the long side portion 138 and the cancel guide plate 224 on the cancel path 222, and the coin C is then returned to the return slot 126.

An attraction apparatus 232 of the false coin FC having a strong magnetism is explained below mainly with reference to FIG. 3. The attraction apparatus 232 separates the false coin FC formed of a strong magnetic material, such as iron and the like. In the present third embodiment, the attraction apparatus 232 is a permanent magnet 234, which has an end portion inserted to a through-hole 230 of the cancel door 134 proximate to the inlet 102, and is fixed by a screw 231. As soon as the false coin FC formed of a strong magnetic material is inserted into the inlet 102, the false coin FC is attracted by the permanent magnet 234, and held on the moving path 106. The false coin FC attracted by the permanent magnet 234 can be canceled by a strong magnetic body cancel apparatus 240.

A pullback prevention apparatus 246 is explained below mainly with reference to FIGS. 2 and 14A. The pullback prevention apparatus 246 prevents fraud in which the true coin TC having passed the true coin sensor 118 is hooked with a silkworm gut and the like, and pulled back. The pullback prevention apparatus 246 has a fan-shaped second stop piece 254 having in an intermediate portion, an axis 252 rotatably supported by an axis receiver 248 provided to the main body plate 132. The second stop piece 254 normally projects due to self moment, to the vertical standing path 201 immediately before the true coin sensor 118. When the coin C passes, however, the second stop piece 254 is moved by the coin C, thus not preventing the coin C from passing. When the coin is pulled up in an opposite direction, however, the second stop piece 254 is rotated in the same direction by the coin C, thus sandwiching the coin C in a space with the main body plate 132 and preventing the coin C from passing.

A disengagement apparatus 274 of the magnetic body 112 is explained below mainly with reference to FIGS. 10, 15A, and 15B. The disengagement apparatus 274 disengages the magnet body 112 from the moving path 106, in conjunction with the cancel door 134 moving to the cancel position CP. Thereby, the false coin FC is canceled, the false coin FC having magnetism attracted by a magnet force of the magnetic body 112 and being held on the moving path 106. In the present third embodiment, the disengagement apparatus 274 has a disengaging and moving body 276, a disengaging and moving support apparatus 278, and a cancel interlocking apparatus 280.

The disengaging and moving support apparatus 278 has the axis 166 supported by the upper end portion of the main body plate 132, axis receivers 286*a* and 286*b* provided to the disengaging and moving body 276, and a biasing body 288. The axis receivers 286*a* and 286*b*, which are mounted tightly sandwiching the axis receiver 164*b*, are rotatable relative to the axis 166, but not slidable in the axis direction. The axis receivers 286*a* and 286*b* are provided with lateral slits 292*a* and 292*b*, through which the axis 166 is received to axis receiving portions 294*a* and 294*b*. The disengaging and moving body 276 is provided integrally extending to the axis receivers 286*a* and 286*b* therebelow, and is provided with an axis receiver 298 having an axis hole 296 extending in an orthogonal direction to the moving path 106. The second fixed axis 186 is rotatably inserted to the axis hole 296. The disengaging and moving body 276 is urged to the main body plate 132 by the biasing body 288, or a spring 302 in the present third embodiment. In other words, the magnet body 188 is also urged to the moving path 106. Thus, the biasing body 288 may be changed to an apparatus having a similar function, such as a weight and the like.

The cancel interlocking apparatus 280 is explained below with reference to FIG. 10. The cancel interlocking apparatus 280 disengages the disengagement apparatus 274, hence the magnet body 112, from the moving path 106, in conjunction with a push-in of the cancel button 124. The cancel interlocking apparatus 280 has an L-shaped lever 284 having an intermediate bent portion rotatably supported by an axis 282 fixed in a vertical standing status to the rear surface of the front plate 122.

Figure 10:
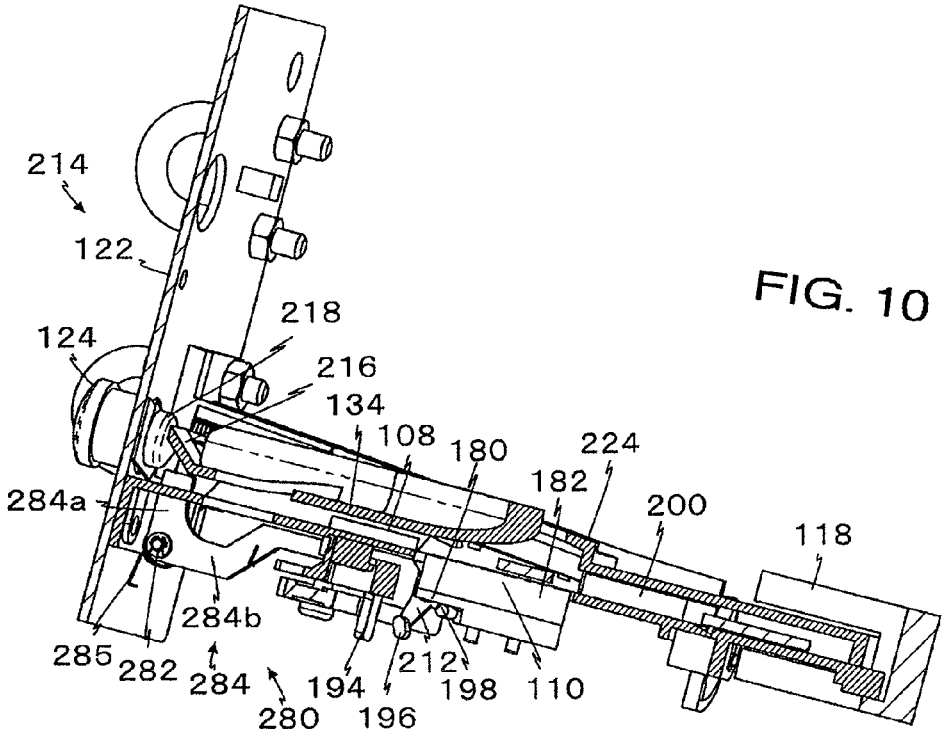
FIG. 10 is a cross-sectional view of the coin sorting apparatus along line Z-Z in FIG. 4 (standby mode)

The lever 284 is urged counterclockwise in FIG. 10 by a spring 285. An end portion of a moved portion 284*a* is normally positioned opposite to a lower end portion of a plate spring 230. A moving portion 284*b* of the lever 284 is pressed against the main body plate 132 and stands still, such that the moving portion 284*b* is normally provided proximate and opposite to a receiving portion 290 (refer to FIG. 15A) extending below the swing lever 188. Thereby, when the cancel button 124 is pressed, the moved portion 284*a* is pressed by the lower end portion of the plate spring 230, and the lever 284 is rotated counterclockwise in FIG. 10. Since the moving portion 284*b* then presses the receiving portion 290 to a side opposite to the main body plate 132, the swing lever 188 is pivoted counterclockwise in FIG. 13 around the axis 166. Thus, the magnet body 112 is moved in a direction away from the main body plate 132, and the magnetic force exerted by the magnetic body 112 on the coin C existing on the moving path 106 is reduced. The false coin FC held by the magnetic force is dropped to the cancel path 222 by self weight, and is canceled.

A magnetic body position adjustment apparatus 304 is explained below mainly with reference to FIGS. 15A an 15B. The magnetic body position adjustment apparatus 304 adjusts a distance between the magnetic body 112 and the moving path 106. Specifically, the magnetic body position adjustment apparatus 304 adjusts a distance between the magnetic body 112 and the coin C rolling on the moving path 106. The magnetic body position adjustment apparatus 304 has a screw hole 306 provided to the disengaging and moving body 276 and an adjustment screw 308 screwed into the screw hole 306. An end portion of the adjustment screw 308 is pressed against a circular flat pedestal 312 provided to the main body plate 132. Thus, when the adjustment screw 308 is further screwed into the screw hole 306, the disengaging and moving body 276 is pivoted counterclockwise in FIG. 15A around the axis 166. As a result, the swing lever 188 is also rotated in the same direction via the second fixed axis 186, and thus the permanent magnetic body 192 is separated from the moving path 106. Conversely, when a screw-in amount of the adjustment screw 308 is reduced, the permanent magnetic body 192 is moved close to the moving path 106. Thus, the magnetic force of the permanent magnetic body 192 relative to the coin C rolling on the moving path 106 can be decreased or increased in proportion to a square of the distance.

Figure 16:
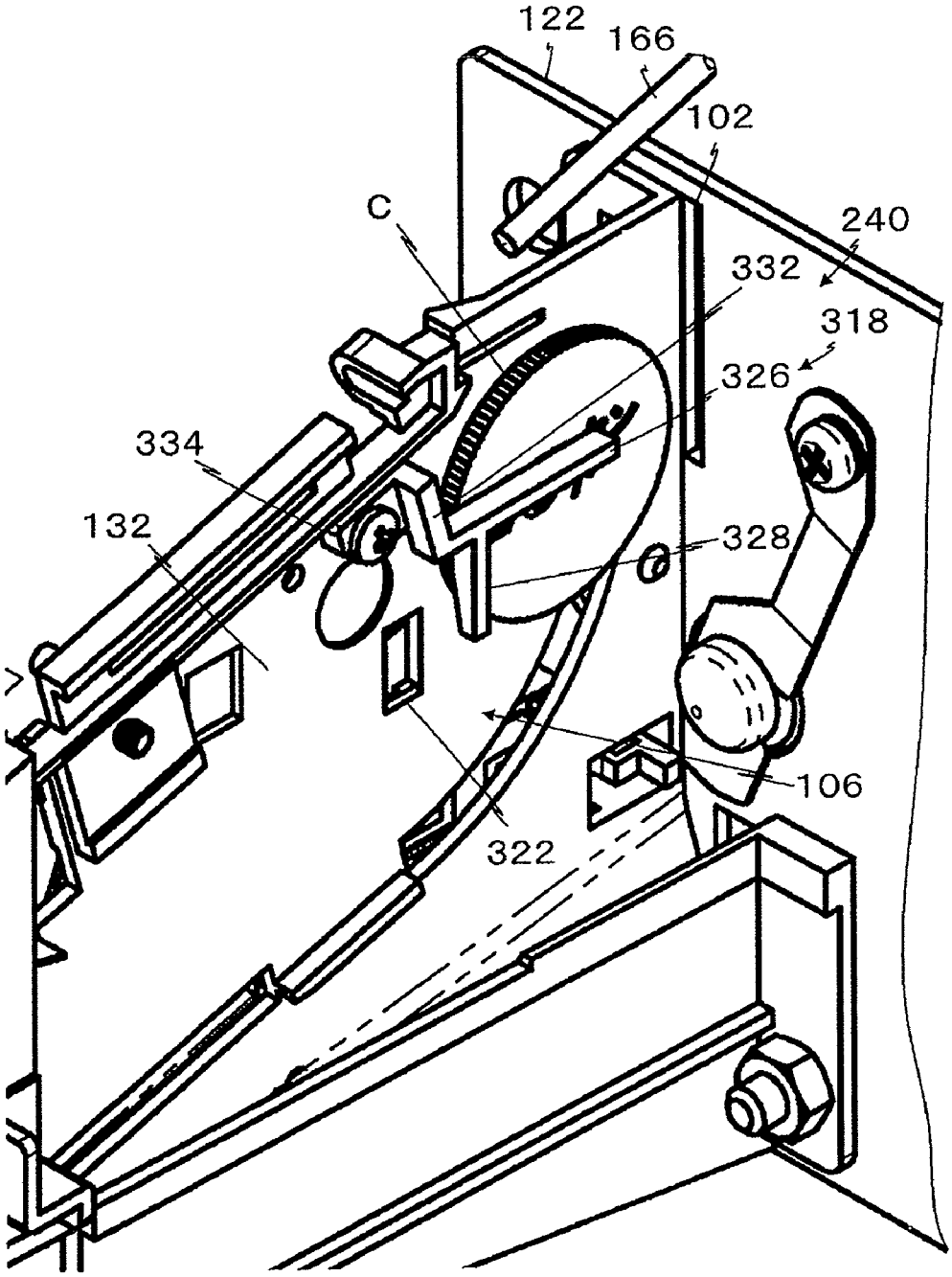
FIG. 16 is a perspective view of the coin sorting apparatus according to the third embodiment of the present invention, when a coin stays in the vicinity of an inlet.

The strong magnetic body cancel apparatus 240 is explained below mainly with reference to FIG. 16. The strong magnetic body cancel apparatus 240 drops the false coin FC formed of a strong magnetic body attracted to the permanent magnet 234 to the cancel path 222 when the cancel button 124 is pressed. The strong magnetic body cancel apparatus 240 has a second stop piece 316 and a holding body 318, the second stop piece 316 laterally projecting from a lower end portion of a second sorting body 314.

The axis 166 is inserted to an axis hole 322 in an upper end portion of the second sorting body 314, and thereby the axis 166 and the second sorting body 314 are integrally rotated. The second stop piece 316 projects to an opening 324 provided to the main body plate 134. When the cancel door 314 is positioned at a sorting position AP (status of FIG. 7), the end portion of the second stop piece 316 is positioned at the opening 324 and does not project to the moving path 106. When the cancel door 134 is rotated to the cancel position CP (status of FIG. 8), however, the second stop piece 316 is rotated in the same direction via the axis 166, and the end portion of the second stop piece 316 projects to the moving path 106. In other words, when the second stop piece 316 is positioned in the moving path 106, the moving path 106 is blocked before the moving guide rail 110, and thus the coin C cannot reach the true coin slot 116.

The holding body 318 is explained below mainly with reference to FIG. 16. The holding body 318 holds the false coin FC on the moving path 106 when the cancel door 134 is moved to the cancel position CP. The holding body 318, which has a deformed T shape, has a horizontal portion 326, a drooping portion 328, and a mount portion 332, the drooping portion 328 extending downward for a predetermined length from an intermediate portion of the horizontal portion 326, the mount portion 332 extending upward from an end portion of the horizontal portion 326. The mount portion 332 is further provided with a fixed portion 334 offset by the horizontal portion 326 and the drooping portion 328. The fixed portion 334 has a thickness thicker than the thickness of the coin C. Specifically, the fixed portion 334 is provided slightly thicker than the width of the inlet 102, and fixed to the main body plate 132. Thus, the horizontal portion 326, the drooping portion 328, and the mount portion 332 are provided in parallel to a space with the main body plate 134, having a distance in between slightly wider than the thickness of the coin C. A lower end portion of the drooping portion 328 is inclined such that a distance is wider toward a lower side relative to the first vertical standing surface 140.

Thereby, when the coin C is pressed by a pressing projection 316 projecting from an opening 322, the coin C is not caught between a drooping portion 338 and the pressing projection 316. The false coin FC attracted on the cancel door 134 side by the permanent magnet 234 is urged to be moved along with the cancel door 134 moving to the cancel position CP. The false coin FC, however, is prevented from being moved by the horizontal portion 326 and the drooping portion 328 of the holding body 318. Eventually, the magnet force exerted by the permanent magnet 234 is reduced, and then the false coin FC is dropped to the cancel path 222 by gravity and canceled.

Operations of the present third embodiment are explained below. Before the apparatus is operated, a position of the magnetic body 112 is determined relative to the moving path 106, such that the magnetic body 112 is moved in the same direction by the true coin TC rolling on the fixed guide rail 108, after the true coin TC is inserted from the inlet 102; and then, the moving guide rail 110 is stably moved to the guide position GP via the interlocking mechanism 114. Specifically, the adjustment screw 308 is screwed in or back from the screw hole 306, and thereby a distance of the permanent magnetic body 192 relative to the moving path 106 is fine tuned.

A case is first explained in which the true coin TC is inserted to the inlet 102. The true coin TC inserted to the inlet 102 is held between the support piece 154 and the diameter regulating body 146 in the cradle 104. Further, a clockwise moment in FIG. 6 is exerted by the weight of the true coin TC, and then the cradle body 144 is rotated in the same direction. When the support piece 154 reaches proximate to the drooping position of the gravity center of the true coin TC, the gravity center of the true coin TC is positioned closer to the fixed guide rail 108 side than the support piece 154, and the true coin TC is positioned opposite to the flat surface 160 of the diameter regulating body 146. Then, the distance between the diameter regulating body 146 and the support piece 154 is widened from G1 to G2. Thereby, the true coin TC rolls and drops to the fixed guide rail 108, and then rolls on the fixed guide rail 108 (refer to FIGS. 9A to 9C, and 18).

The roll causes an eddy current in copper, which is the strong conductive portion of the true coin TC, due to an operation of the permanent magnetic body 192. The eddy current causes the true coin TC to generate an opposite polar magnet force to the permanent magnet body 192. Since the true coin TC and the permanent magnet body 192 generating the magnet forces repel each other, the permanent magnet body 192 is moved in the rolling direction by the roll of the true coin TC on the fixed guide rail 108, and the swing lever 188 is largely rotated counterclockwise in FIG. 4 and enters a state of FIG. 19.

Figure 11:
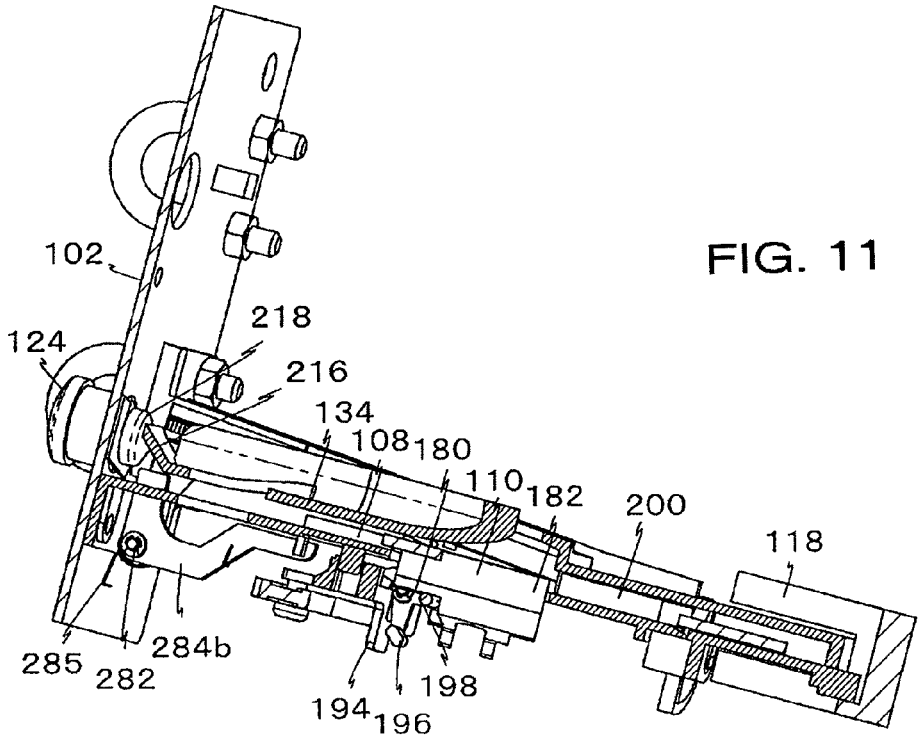
FIG. 11 is a cross-sectional view of the coin sorting apparatus along line Z-Z in FIG. 4 (when a true coin passes)

In the rolling process, the pressing piece 194 presses the interlocking moved piece 196, and thus the interlocking body 204 is rotated counterclockwise in FIG. 10, and enters a status of FIG. 11. The rotation causes the interlocking pressing piece 198 to press the moved edge 180 of the moving guide rail 110. The press moves the moving guide rail 110 to the guide position GP. The true coin thus rolls on the moving guide rail 110 subsequent to the fixed guide rail 108, and then on the second fixed guide rail 200. The end 272 of the detection body 256 contacts with the peripheral surface of the true coin TC rolling on the moving guide rail 110, and engages with the groove GC of the reeding G. Thereby, the detection body 256 is moved in the extension direction thereof, and moves the receiving portion 264. Accordingly, the axis receiver 262 is rotated counterclockwise in FIG. 5, and the sorting body 121 is also rotated in the same direction and retracted from the moving path 106. Then, the true coin TC rolls on the second fixed guide rail 200 and drops to the true coin slot 116, and is stored in the safe.

In the process in which the true coin TC rolls on the moving guide rail 110, the reeding G is detected by the reeding detection apparatus 120. Specifically, the end 260 of the detection body 256 is engaged with the groove GC of the reeding G, and then the detection body 256 is pressed to the left in FIG. 5 (refer to FIG. 20). Thereby, the detection body 256 is moved in the same direction as being guided by the first projection 236, the second projection 238, and the third projection 242; and the axis receiver 262 is rotated counterclockwise in FIG. 5 via the receiving portion 264. Consequently, the sorting body 121 is moved to the pass position PP, and the release body 277 is positioned on the moving path 106 (refer to FIG. 21). The true coin TC rolling on the second fixed guide rail 200 presses the release body 277 away and rolls; rotates the axis receiver 262 from the position in FIG. 22 to the position in FIG. 23 and passes; and then drops to the vertical standing path 201 (refer to FIG. 23). The rotation returns the sorting body 121 to the second stop position SP2.

The true coin sensor 118 detects the true coin TC before the true coin TC drops to the true coin slot 116, and outputs a detection signal. The detection signal indicates that a single true coin TC is stored in the safe. The swing lever 188 rotated by the true coin TC swings due to gravity, and stands still at the drooped standby position SP. When the coin C has no reeding G, the end 272 is not engaged with the groove GC, and thus the detection body 256 merely climbs up to the apex portion of the coin C along the peripheral surface thereof (refer to FIG. 24). In this case, the receiving portion 264 is not moved, and thus the axis receiver 262 is not rotated and the sorting body 121 is held at the moving path 106. As a result, the coin C is stopped from moving on the moving path 106 by the sorting body 121. In the state in which the coin C is stopped from moving on the moving path 106 by the sorting body 121, the coin C is positioned on the front upward inclined surface 211 and disengaged from the moving guide rail 110. Thus, the moving guide rail 110 returns to the standby position SP by the self moment. Consequently, the coin C rolls to the inlet 102 side due to the inclination of the front upward inclined surface 211. Since the moving guide rail 110 does not exist, however, the coin C drops to the cancel path 222 and is returned to the return slot 126. Specifically, the false coin FC, which has no reeding G on the peripheral surface, is separated from the true coin TC.

When the coin C is stopped by the sorting body 121 and retained on the moving path 106, pressing the cancel button 124 moves the cancel door 134 to the cancel position CP, and thus drops the coin C to the cancel path 222 by self weight since one side surface cannot be supported. The canceled false coin FC rolls on the cancel path 222 and is returned to the return slot 126.

When the coin sorting apparatus 100 is tilted within a flat surface including the moving path 106, the swing lever 188 and the second swing lever 208 maintain the drooping status due to gravity. Accordingly, the positional relationship between the swing lever 188 and the moved edge 180 of the moving guide rail 110 changes. Since the positional relationship between the moved edge 180 and the interlocking moved piece 196 does not change (refer to FIG. 19), however, the positional relationship does not change in which unless the swing lever 188 is rotated more than a predetermined amount, the moving guide rail 110 is not moved to the guide position GP. Thus, even when the coin sorting apparatus 100 is intentionally tilted, the apparatus is not affected by the tilt.

A case is explained below in which the false coin FC is inserted, the false coin FC having the same diameter and weight as the true coin TC and being formed of a non-magnetic material. The non-magnetic false coin FC rolls on the fixed guide rail 108 subsequent to the cradle 104, no magnetic field is generated since an eddy current is not generated in the false coin FC by the permanent magnetic body 192. As a result, the swing lever 188 is swung by the false coin FC, and thus the false coin FC is dropped from the downstream end portion of the fixed guide rail 110 to the cancel path 222, without rolling on the moving guide rail 108, and then returned to the return slot 126.

A case is explained below in which the false coin FC is inserted, the false coin FC having the same diameter and weight as the true coin TC and having a weak/medium conductivity. In this case, when the false coin FC rolls on the fixed guide rail 108, an eddy current is generated in the false coin FC by the magnetic force of the permanent magnetic body 192, and a magnetic field is generated in the false coin FC. However, the generated magnetic force is small, and a rotation amount of the swing lever 188 is small. Thus, the moving guide rail 110 is not moved to the guide position GP via the interlocking mechanism 114. As a result, the false coin FC is dropped to the cancel path 222 and returned to the return slot 126, similar to the false coin FC above.

A case is explained below in which the false coin FC is inserted, the false coin FC having the same diameter and weight as the true coin TC and having non-strong conductivity and non-magnetism. When the non-magnetic false coin FC rolls on the fixed guide rail 108, no eddy current is generated in the false coin FC by the magnetic force of the permanent magnetic body 192. Further, there is no magnetic field, and thus the permanent magnetic body 192 is not attracted. In other words, the magnetic body 112 is not moved by the false coin FC, and thus the moving guide rail 110 is not moved to the guide position GP. As a result, the false coin FC is dropped from the fixed guide rail 108 and returned to the return slot 126 by way of the cancel path 222.

A case is explained below in which the false coin FC having a strong magnetism is inserted. When the false coin FC having a strong magnetism is inserted, the false coin FC is attracted by the permanent magnet 234 disposed proximate to the inlet 102 and unable to proceed to the cradle 104. The false coin FC is thus stopped at the moving path 106 proximate to the inlet 102. Specifically, the false coin FC is retained on the moving path 106 between the horizontal portion 326 or the drooping portion 328 of the holding body 318 and the main body plate 132. When the cancel button 124 is pressed, the false coin FC attracted by the permanent magnet 234 moves the cancel door 134 to the cancel position CP. Thereby, the false coin FC is detached from the permanent magnet 234. Since the magnetic force exerted on the false coin FC is suddenly reduced, the false coin FC is dropped to the cancel path 222 and canceled.

A case is explained below in which the false coin FC having a strong magnetism is inserted and pressed into a side of the magnetic body 112 by a separate planar body. In this case, the false coin FC can rotate the swing lever 188 as being magnetized by the magnetic force of the permanent magnetic body 192, and move the moving guide rail 110 to the guide position GP via the interlocking mechanism 114. The false coin FC, however, is retained on the moving path 106, in a state being tightly attached to the main body plate 132 as being magnetized by the magnetic force of the permanent magnetic body 192. When the false coin FC is retained on the moving path 106, the cancel button 124 is pressed so as to move the cancel door 134 to the cancel position CP. Thereby, the false coin FC can be dropped to the cancel path 222. Meanwhile, the lever 284 is rotated clockwise from the position in FIG. 10, and thus the receiving portion 290 is pressed in the direction away from the main body plate 132, and is rotated counterclockwise as shown in FIG. 8. Thereby, the permanent magnetic body 192 disengages from the moving path 106; the magnetic force exerted on the false coin FC is suddenly reduced; and thus the false coin FC is dropped to the cancel path 222 by self weight.

A case is explained below in which the false coin FC is inserted, the false coin FC having the same diameter as the true coin TC and having a light weight. In this case, the false coin FC is placed between the diameter regulating body 146 and the support piece 154. Due to insufficient weight, however, a predetermined moment is not generated. The false coin FC thus remains placed on the cradle 104, and is separated from the true coin TC. When the false coin FC is placed on the cradle 104, the cancel button 124 is pressed so as to move the cancel door 134 to the cancel position CP. Thereby, the cradle 104 moves along with the cancel door 134, and concurrently the placed surface of the diameter regulating body 146 and the support piece 154 are inclined downward. Then, the false coin FC is dropped to the cancel path 222 and returned to the return slot 126.

Fourth Embodiment

A fourth embodiment of a coin sorting apparatus 100 according to the present invention is explained below. In the fourth embodiment, the inclination correction mechanism 206 of the third embodiment is not equipped, and the reeding detection apparatus 120 is mounted. Specifically, the interlocking mechanism 114 is fixed to the main body plate 132. In the fourth embodiment, functional portions same as those in the third embodiment are provided with the same numeral references, and explanations thereof are omitted. In the fourth embodiment, a device mounted with the coin sorting apparatus 100 is fixed to a floor and the like with an anchor bolt and the like. It is thus effective in a case in which the device cannot be intentionally tilted. The coin sorting apparatus 100 of the fourth embodiment has an advantage that allows an inexpensive configuration with no inclination correction mechanism 206.

In the fourth embodiment, the support axis 212 of the interlocking mechanism 198 is provided standing on a bracket 334 position-adjustably attached to a main body plate 182. The bracket 334 is fixed to a predetermined position by a screw 338 screwed into the main body plate 182 through a laterally provided elongated hole 336. In other words, a position of the support axis 212 is fixed to an optimum position by adjusting the attachment position of the bracket 334. When the pressing piece 194 of the swing lever 188 presses the interlocking moved piece 196, the interlocking body 204 is rotated, and the interlocking pressing piece 198 presses the moved edge 180. Thus, the moving guide rail 110 is moved to the guide position GP. Operations and effects are the same as in the first embodiment. A plurality of projecting rails 336 are radially provided centering the second fixed axis 186 on the rear surface of the main body plate 132 opposite to the swing lever 188. Thereby, fraud is prevented in which when a strong magnetic body is inserted from the inlet 102, the swing lever 188 is swung, and the moving guide rail 110 is moved to the guide position GP. Specifically, the swing lever 188 is suctioned by the strong magnetic body and tightly attached to the rear surface of the main body plate 132. A projection provided to the rear surface of the main body plate 132 (not shown in the drawing) is engaged with the projection rails 336, and thereby the swing lever 188 is not moved fraudulently.

The present invention can be used as a detection apparatus of coin reeding. Further, the prevent invention can be used as a mechanical coin sorting apparatus for U.S. 25 cent coins having reeding, non-magnetism, and strong conductivity.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. A coin sorting apparatus having a reeding detection apparatus that detects reeding of a coin having the reeding on a periphery thereof and separates the coin as a true coin, the coin sorting apparatus comprising:

a detection body provided above a guide rail on which the coin inserted to an inlet rolls; and a sorting body positioned at a coin path provided downstream of the guide rail, wherein:

the detection body is movable in an extension direction of the guide rail, the detection body is provided with an end contactable with an upper end portion of a peripheral surface of the coin rolling on the guide rail, the sorting body is moved to a sorting position of a true coin in conjunction with a movement of the detection body, wherein:

the detection body has an elongated plate shape, and is provided movably upward within a predetermined range in the extension direction of the guide rail and relative to the guide rail, by guides provided above and below in an intermediate portion;

a rear end of the detection body is engaged with a receiving portion rotatably provided to a support axis;

the receiving portion is connected so as to be moved in a predetermined direction when the end of the detection body is pressed by the reeding of the coin;

the sorting body is provided, such that the sorting body is normally positioned at the coin path provided downstream of the end of the detection body so as to stop the coin from moving, and is moved to a position that does not stop the coin from moving in conjunction with a movement of the receiving portion; and a release body is provided, such that the release body is normally positioned external to the coin path provided downstream of the sorting body, and is moved to the coin path in conjunction with a movement of the sorting body to the position that does not stop the coin from moving.

2. The coin sorting apparatus having the reeding detection apparatus according to claim 1, wherein the receiving portion, the sorting body, and the release body are integrally provided projecting in a circumferential direction from a ring-shaped axis receiver rotatably supported to the support axis.

3. The coin sorting apparatus having the reeding detection apparatus according to claim 1, wherein the detection body is provided with a plurality of elongated plate-shaped bodies having ends disposed displacing in the extension direction of the guide rail.

4. The coin sorting apparatus having the reeding detection apparatus according to claim 1, wherein the detection body is provided with a plurality of elongated plate-shaped bodies having ends disposed displacing in the extension direction of the guide rail.

5. The coin sorting apparatus having the reeding detection apparatus according to claim 2, wherein the detection body is provided with a plurality of elongated plate-shaped bodies having ends disposed displacing in the extension direction of the guide rail.

* * * * *